US011609524B2

(12) United States Patent
Kubo et al.

(10) Patent No.: US 11,609,524 B2
(45) Date of Patent: Mar. 21, 2023

(54) IMAGE FORMING APPARATUS

(71) Applicant: CANON KABUSHIKI KAISHA, Tokyo (JP)

(72) Inventors: Yukio Kubo, Tokyo (JP); Yu Fukasawa, Tokyo (JP); Daisuke Abe, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/528,333

(22) Filed: Nov. 17, 2021

(65) Prior Publication Data

US 2022/0075308 A1 Mar. 10, 2022

Related U.S. Application Data

(63) Continuation of application No. 16/937,849, filed on Jul. 24, 2020, now Pat. No. 11,204,575.

(30) Foreign Application Priority Data

Jul. 29, 2019 (JP) ..... JP2019-139114
Jun. 5, 2020 (JP) ..... JP2020-098542

(51) Int. Cl.
*G03G 15/00* (2006.01)
*G03G 15/02* (2006.01)

(52) U.S. Cl.
CPC ..... *G03G 15/6552* (2013.01); *G03G 15/0266* (2013.01); *G03G 15/50* (2013.01)

(58) Field of Classification Search
CPC ..... G03G 15/0266; G03G 15/0863; G03G 15/50; G03G 15/6552
See application file for complete search history.

(56) References Cited

U.S. PATENT DOCUMENTS

| | | | | |
|---|---|---|---|---|
| 9,291,994 | B2 | 3/2016 | Kanno et al. | |
| 9,304,484 | B2 | 4/2016 | Ogino et al. | |
| 9,836,016 | B2 * | 12/2017 | Kawakami | G03G 21/1871 |
| 10,095,178 | B2 | 10/2018 | Ogino et al. | |
| 10,564,594 | B2 | 2/2020 | Ogino et al. | |
| 11,204,566 | B2 * | 12/2021 | Fukasawa | G03G 15/0863 |
| 2012/0148298 | A1 * | 6/2012 | Jeong | G03G 21/1871 399/119 |

FOREIGN PATENT DOCUMENTS

| | | |
|---|---|---|
| JP | 2015-062053 A | 4/2015 |
| JP | 2016-008977 A | 1/2016 |

* cited by examiner

*Primary Examiner* — Hoang X Ngo
(74) *Attorney, Agent, or Firm* — Venable LLP

(57) ABSTRACT

An image forming apparatus of the present invention includes: a body; a developing cartridge having a memory medium and a developer bearing member; a tray including a frame which is movable between a housed position and a drawn-out position and has side portions extending in the moving direction and to which the developing cartridge is attachable, an image bearing member that faces the developer bearing member when the developing cartridge is attached, a tray-side metal terminal provided on the side portion and electrically connected to the memory medium when the cartridge is attached, and a tray guide portion extending along the moving direction; a body-side metal terminal that faces the tray-side metal terminal when the tray is housed, wherein the tray-side metal terminal is provided below the tray guide portion.

11 Claims, 28 Drawing Sheets

W-W

IMAGE FORMING APPARATUS

This is application is a continuation of application Ser. No. 16/937,849, filed Jul. 24, 2020.

BACKGROUND OF THE INVENTION

Field of the Invention

The present invention relates to an image forming apparatus.

Description of the Related Art

Conventionally, electrophotographic image forming apparatuses such as a laser printer or an LED printer are known. In such image forming apparatuses, a system which enables a developing cartridge housing a developer such as toner to be detachably attached is known. A cartridge tray for attaching the developing cartridge may be provided in such an image forming apparatus. A photosensitive drum is provided in the cartridge tray at a position at which the photosensitive drum faces a developing roller included in the developing cartridge when the developing cartridge is attached thereto. The toner in the developing cartridge is supplied to the photosensitive drum on which an electrostatic latent image is formed by selective exposure after charging via the developing roller, whereby developing is performed.

When an image forming apparatus including a developing cartridge and a cartridge tray is used, users can easily draw the cartridge tray out from an apparatus body to replace the developing cartridge. Japanese Patent Application Publication No. 2016-008977 discloses an image forming apparatus of such a system in which a developing cartridge is attached to a cartridge tray. Beside this, an image forming apparatus in which a process cartridge that integrates a photosensitive drum and a developing cartridge into a single unit is detachably attached to a cartridge tray is also known.

In this case, information on a developing cartridge is sometimes necessary for apparatus control by a control unit of an image forming apparatus body and life management of the developing cartridge. Examples of the information on the developing cartridge include yield information such as the number of printable sheets and information indicating a residual developer amount. In order to store such information, a method of providing a memory medium such as a contact IC chip in a developing cartridge is known. Information on the cartridge can be notified to the user by bringing an electrical contact surface of the memory medium into contact with an electrical contact of the cartridge tray or the apparatus body. Japanese Patent Application Publication No. 2015-062053 discloses a memory medium that stores such information on a cartridge.

SUMMARY OF THE INVENTION

In an image forming apparatus in which a developing cartridge has a memory medium, when an electrical contact for the memory is provided in a cartridge tray, it is necessary to electrically connect the electrical contact of the cartridge tray to an apparatus body. For example, as a typical attachment form of a cartridge, the cartridge is attached to the cartridge tray in a direction of crossing perpendicularly to a drawing-out/attachment direction of the cartridge tray from/to the apparatus body. In this case, a connector may be provided in a surface that is most downstream in an insertion direction and is perpendicular to the drawing-out/attachment direction of the cartridge tray from/to the apparatus body and the connector may be connected to a body-side connector.

However, in such a configuration, a component space for providing connectors is necessary. As a result, there are problems that the size of the image forming apparatus increases by the amount of the component space and a developer capacity in the developing cartridge is reduced to secure the component space.

When information is electrically transmitted from a memory medium of the developing cartridge to the apparatus body via the body-side connector, it is also necessary to electrically connect the body-side connector to a body-side electrical substrate. In this case, routing of wiring is necessary, and when the wiring becomes complex, the apparatus size increases to secure the routing space.

The present invention has been made in view of the above-described problems, and an object thereof is to realize electrical connection between an apparatus body and a memory medium in an image forming apparatus of a system in which a developing cartridge having the memory medium provided therein is attached to a cartridge tray while suppressing increase in an apparatus size.

The present application provides an image forming apparatus comprising:

a body;

a developing cartridge which stores a developer, the developing cartridge including:

a casing, a memory medium provided in the casing, the memory medium configured to store information on the developing cartridge, and a developer bearing member which bears the developer;

a tray which is movable between a housed position at which the tray is housed in a housing portion of the body and a drawn-out position at which the tray is drawn out from the body, the tray including:

a frame which has two side portions extending in a moving direction of the tray and to which the developing cartridge is attachable;

a charging unit, an image bearing member which is provided to face the developer bearing member when the developing cartridge is attached to the frame, is charged by the charging unit, and receives supply of the developer from the developer bearing member, has a surface on which an electrostatic latent image is to be formed;

a tray-side metal terminal provided on any one of the two side portions and electrically connected to the memory medium when the developing cartridge is attached to the frame, and a tray guide portion provided on the two side portions along a moving direction of the tray;

a body-side metal terminal provided in the body, the body-side metal terminal facing the tray-side metal terminal and being electrically connected to the tray-side metal terminal when the tray is at the housed position;

a control unit which performs reading or writing of the information from or to the memory medium via the body-side metal terminal and the tray-side metal terminal; and a rail portion provided in the body to face the tray guide portion and enable the tray to move, wherein the tray-side metal terminal is provided below the tray guide portion.

According to the present invention, it is possible to realize electrical connection between an apparatus body and a memory medium in an image forming apparatus of a system in which a developing cartridge having the memory medium provided therein is attached to a cartridge tray while suppressing increase in an apparatus size.

Further features of the present invention will become apparent from the following description of exemplary embodiments with reference to the attached drawings.

DESCRIPTION OF THE EMBODIMENTS

In the following description, exemplary embodiments of the present invention will be described in detail with reference to the drawings and embodiments. Functions, materials, dimensions, shapes, relative positions, and the like of constituent components described in the embodiment are not construed to limit the scope of this invention unless specified particularly. The functions, materials, dimensions, shapes, relative positions, and the like of members described once in the following description are the same as those described initially unless specified particularly again.

In the following description, a side of an image forming apparatus where a front door is provided is referred to as a front surface and a surface on the opposite side of the front surface is referred to as a rear surface. A left side when the image forming apparatus is seen from the front surface is referred to as a driving side and the right side is referred to as a non-driving side.

An extension direction of a drum axial line of a photosensitive drum of a cartridge tray is referred to as a "first direction", a "longitudinal direction", or "longitudinal". A direction crossing the first direction (a direction of attaching a developing cartridge to the cartridge tray or a direction of taking the developing cartridge out from the cartridge tray (that is, an attachment/detachment direction of the cartridge)) is referred to as a "second direction". A direction of using the cartridge tray in the image forming apparatus body or a direction of drawing the cartridge tray out from the apparatus body (that is, a moving direction of the cartridge tray) is referred to as a "third direction". The first and second directions cross each other and are preferably orthogonal to each other. The second and third directions cross each other and are preferably orthogonal to each other. The first and third directions cross each other and are preferably orthogonal to each other.

Embodiment 1

An image forming apparatus 1, a developing cartridge 8, and a cartridge tray 3 according to Embodiment 1 will be described.

Configuration of Image Forming Apparatus

Figure 1:
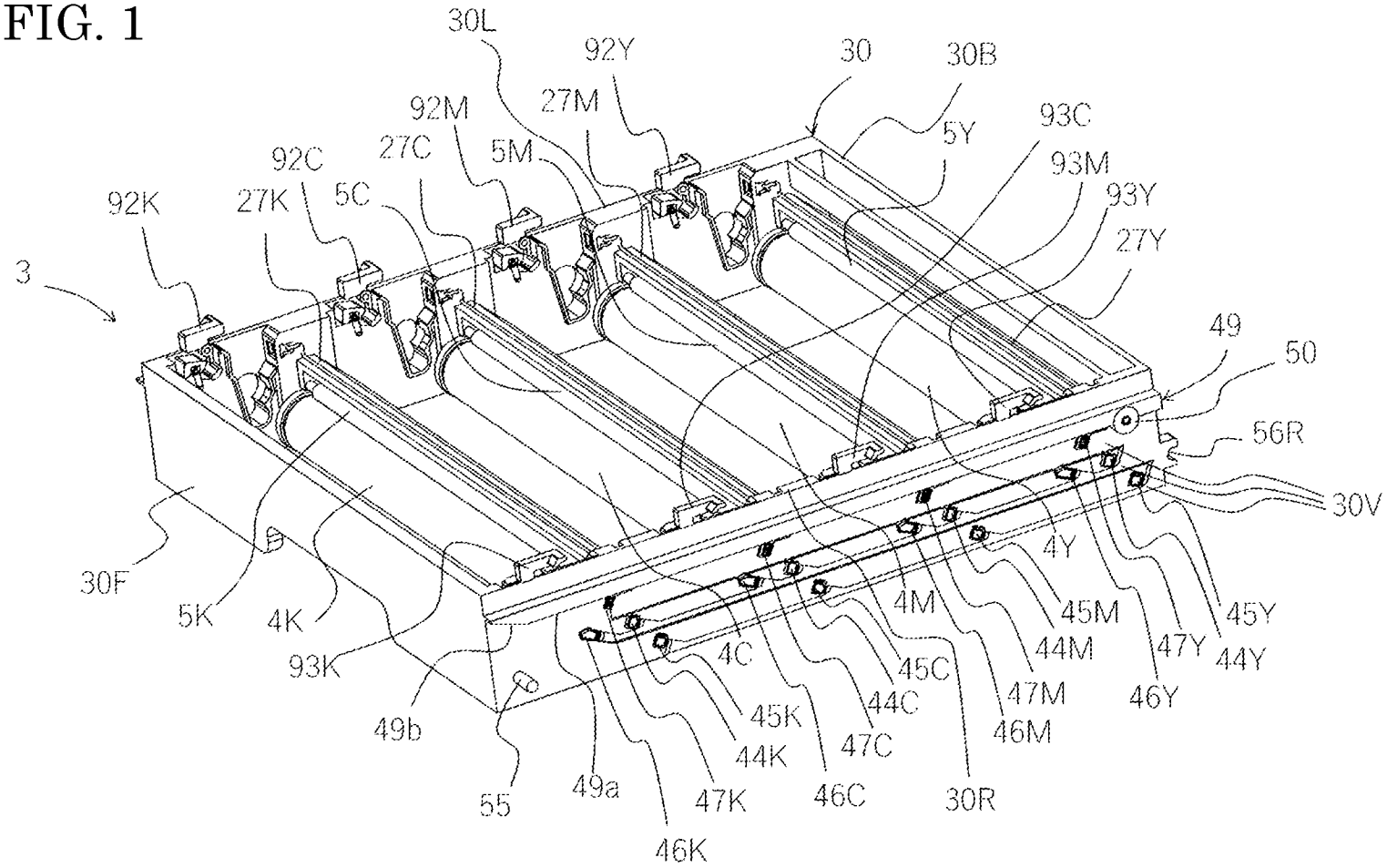
FIG. 1 is a perspective view of a cartridge tray according to Embodiment 1.
Figure 2:
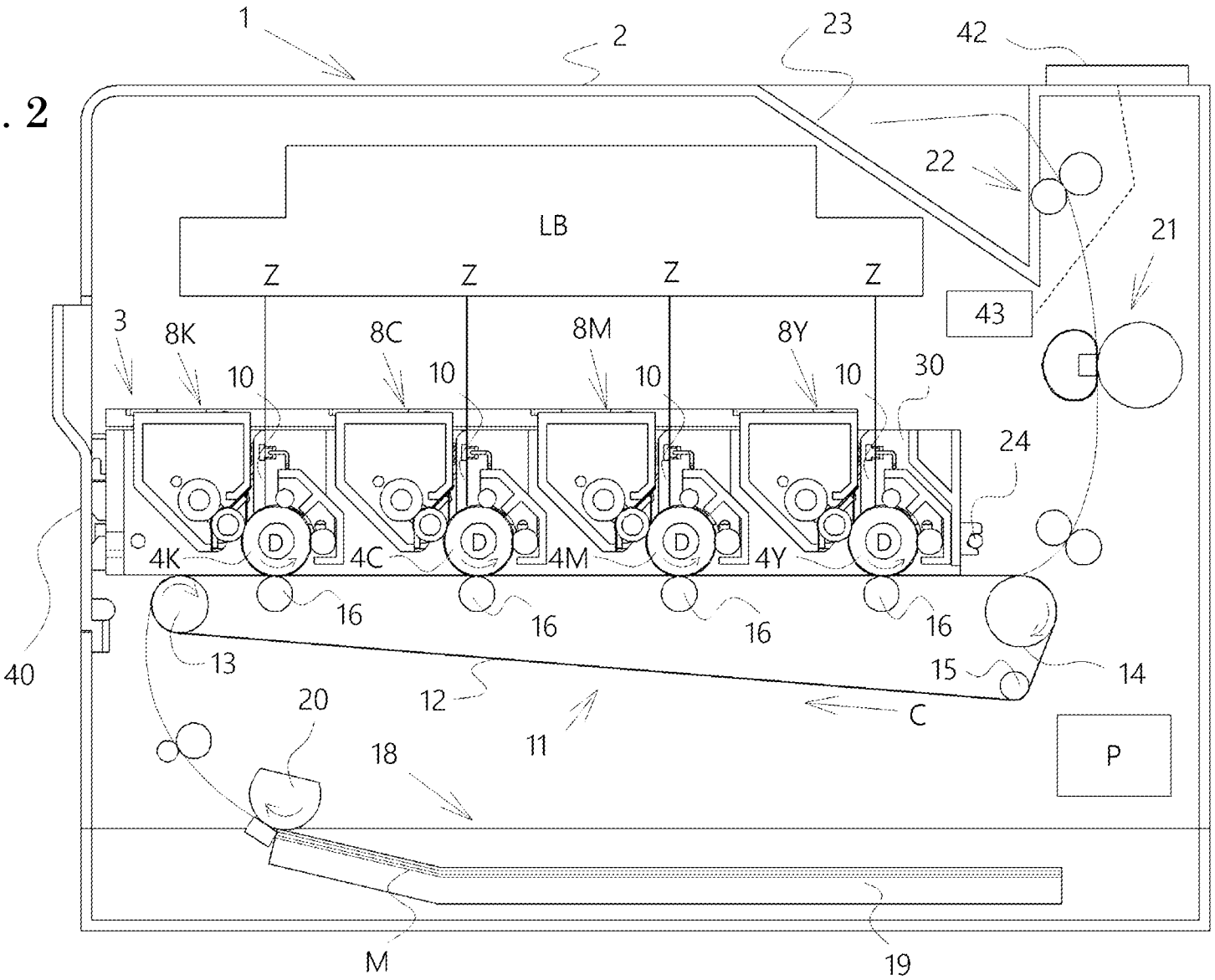
FIG. 2 is a cross-sectional schematic view of an image forming apparatus according to Embodiment 1.
Figure 3A:
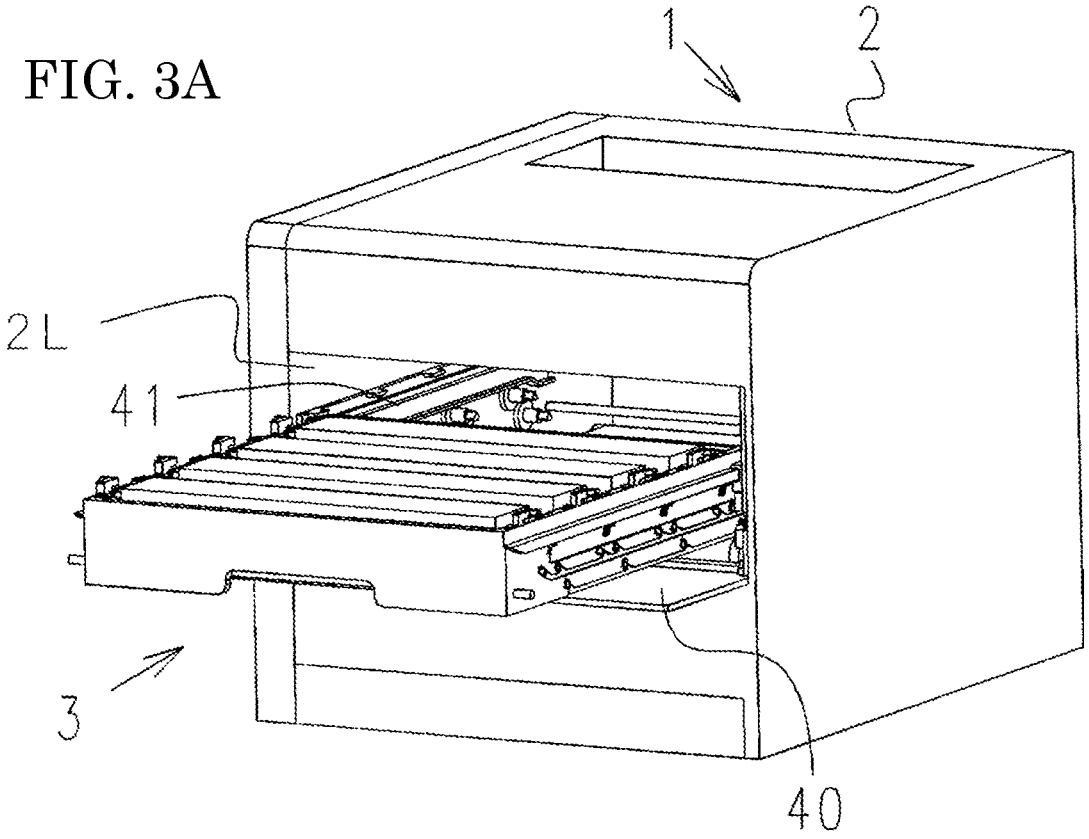
FIG. 3A is a perspective view of a state in which the tray of the image forming apparatus according to Embodiment 1 is drawn out.
Figure 3B:
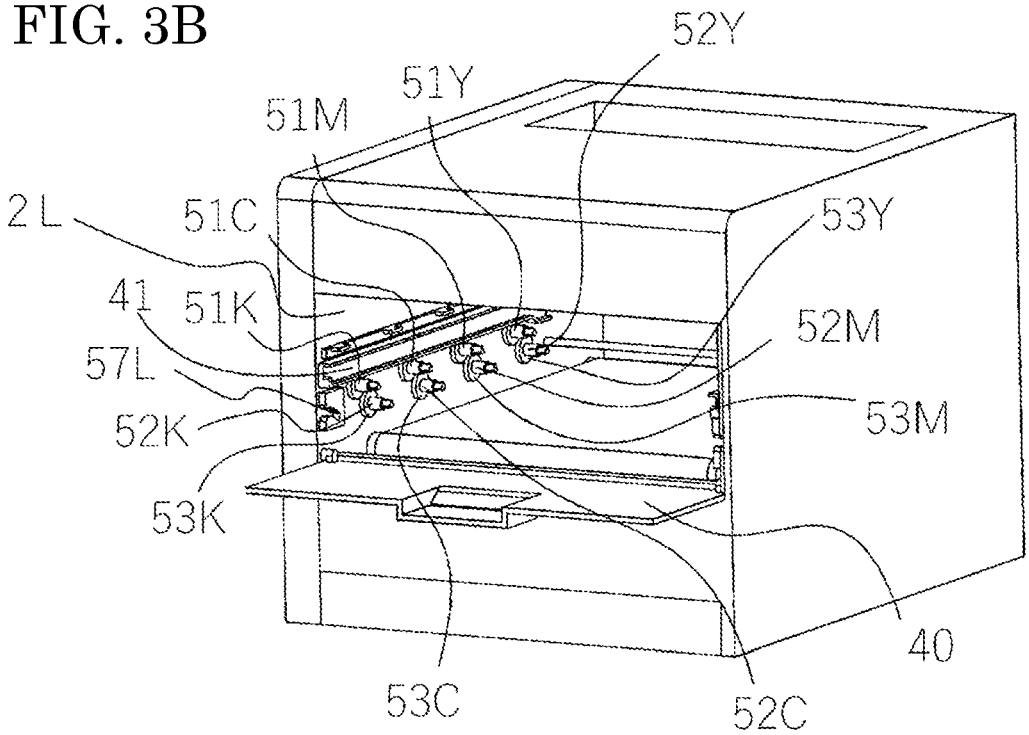
FIG. 3B is a perspective view of a state in which the tray of the image forming apparatus according to Embodiment 1 is taken out.
Figure 3C:
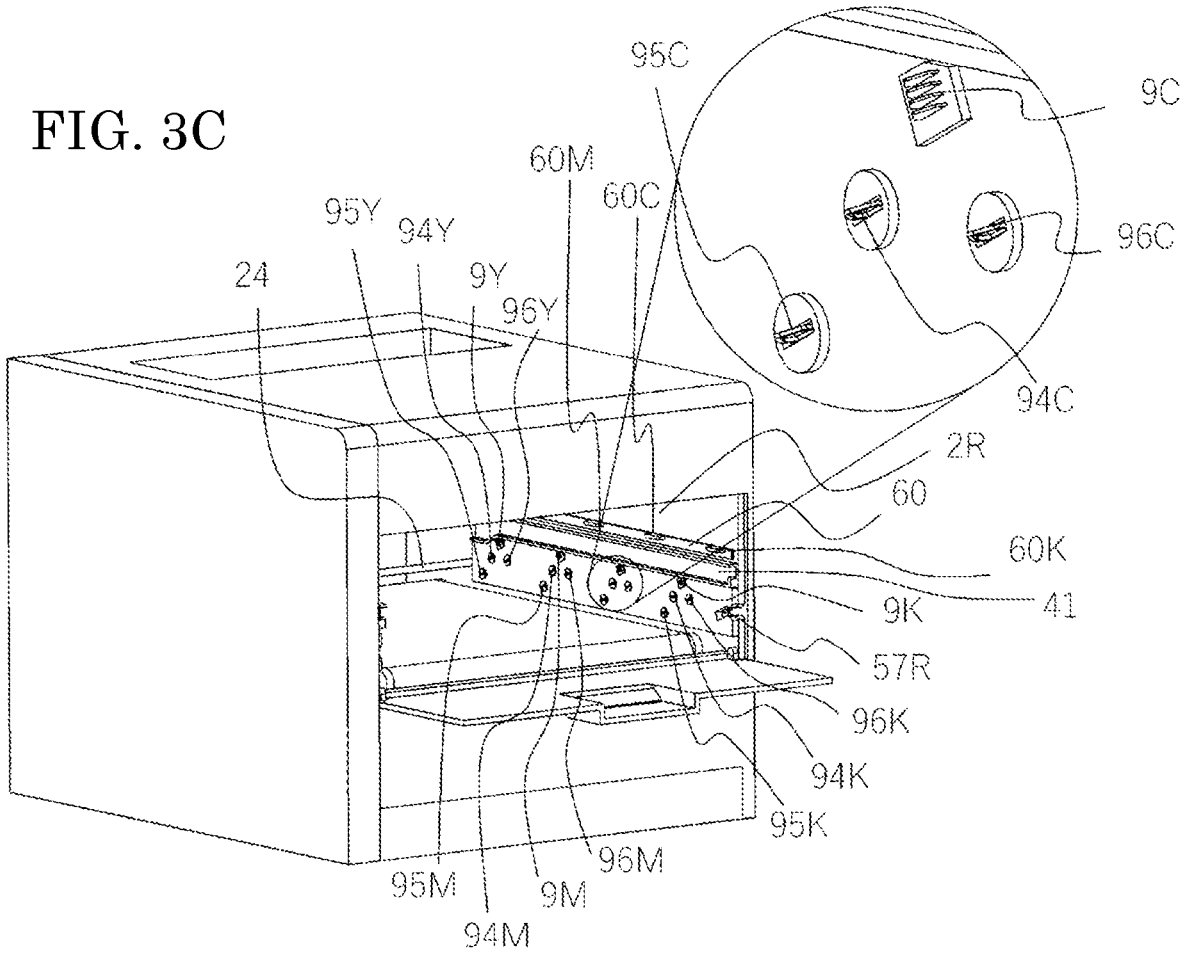
FIG. 3C is another perspective view of a state in which the tray of the image forming apparatus according to Embodiment 1 is taken out.
Figure 4:
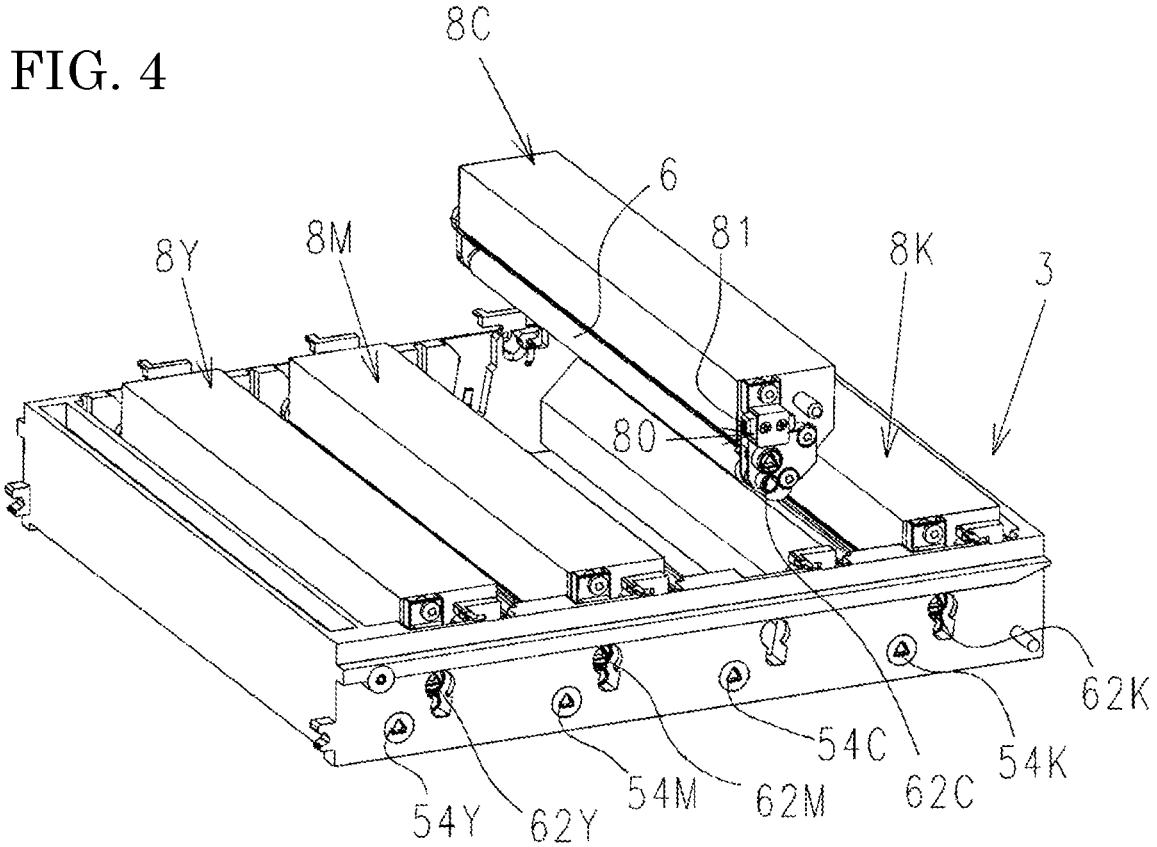
FIG. 4 is a perspective view of a cartridge tray and a developing cartridge according to Embodiment 1.

FIG. 1 is a perspective view of the cartridge tray 3 according to the present embodiment. FIG. 2 is a cross-sectional schematic view of the image forming apparatus 1 according to the present embodiment. FIGS. 3A to 3C are perspective views of the image forming apparatus 1 according to the present embodiment. FIG. 4 is a perspective view of the cartridge tray 3 and the developing cartridge 8 according to the present embodiment.

The image forming apparatus 1 includes an apparatus body 2, the cartridge tray 3, and the developing cartridge 8 as main components. As illustrated in FIGS. 2 and 3A to 3C, the image forming apparatus 1 of the present embodiment is a four-color full-color laser printer which uses an electrophotographic image forming process. In the image forming apparatus 1, the cartridge tray 3 can be housed in a casing portion inside the body. The cartridge tray 3 can attach four developing cartridges 8 (8Y, 8M, 8C, and 8K) thereto. The image forming apparatus 1 forms an image on a recording medium M (for example, a printing sheet) using a developer (for example, toner) supplied from the developing cartridge 8.

In the following description, when the same members are provided for respective colors (Y, M, C, and K), the members are distinguished by appending the names of colors to the ends of reference numerals. When the same members are provided on left and right sides, the members are distinguished by appending R and L to the ends of reference numerals.

In the present embodiment, four developing cartridges 8 can be attached to one cartridge tray 3. The four developing cartridges 8 house developers of different colors (for example, the colors of yellow, magenta, and cyan). However, the number of developing cartridges 8 attached to the cartridge tray 3 is not limited thereto, the number may be three or smaller or five or more. The kinds of colors are not limited thereto. An arrangement order of the colors is not limited to the example of FIG. 2. For example, developing cartridges may be arranged in the order of YMCK from the left side in FIG. 2.

As illustrated in FIGS. 2 to 4, the image forming apparatus 1 includes a laser scanner unit LB as an exposure unit, a transfer belt unit 11 as a transfer unit, a sheet feeding unit 18 as a feeding unit, a fixing unit 21 as a fixing unit, and a discharge unit 22 as a discharge unit. The laser scanner unit LB as an exposure unit is provided above the cartridge tray 3 and the developing cartridges 8 (8Y, 8M, 8C, and 8K).

The laser scanner unit LB outputs a laser beam Z corresponding to image information. The laser beam Z passes through an exposure window 10 to scan and expose the surfaces of photosensitive drums 4 (4Y, 4M, 4C, and 4K) as image bearing members. In this way, an electrostatic latent image is formed on the photosensitive drum. The transfer belt unit 11 as a transfer unit is provided below the cartridge tray 3 and the developing cartridges 8 (8Y, 8M, 8C, and 8K). The transfer belt unit 11 has a driving roller 13 and tension rollers 14 and 15 and stretches a transfer belt 12 which has plasticity.

The photosensitive drums 4 (4Y, 4M, 4C, and 4K) provided in the cartridge tray 3 are in contact with an upper surface of the transfer belt 12. This contacting portion is a transfer portion. A transfer roller 16 is provided on the inner side of the transfer belt so as to face the photosensitive drums 4 (4Y, 4M, 4C, and 4K). A prescribed bias is applied to the transfer roller 16 during transfer, and charges are applied to the recording medium M via the transfer belt 12. Due to an electric field generated at that time, a developer image on the photosensitive drum 4 is transferred to the recording medium M being in contact with the photosensitive drum 4.

The sheet feeding unit 18 is provided below the transfer belt unit 11. The sheet feeding unit 18 has a sheet feeding roller 20 and a sheet feeding tray 19 that can stack and store the recording medium M. The fixing unit 21 and the discharge unit 22 are provided above the apparatus body 2. The recording medium M having a developer image transferred thereto is fixed by the fixing unit 21 and is discharged to a discharge tray 23 via the discharge unit 22.

A power supply device P as a power supply unit is disposed inside the image forming apparatus body or is connected to the image forming apparatus body. The power supply device P supplies electric power to a charging contact 94 as a body-side charging contact portion, a cleaner contact 95 as a body-side cleaner contact portion, and a developing contact 96 as a body-side developing contact portion via electrical wirings (not illustrated). These contacts are electrically connected to a tray-side charging contact 44 as a tray-side charging contact portion, a tray-side cleaner contact 45 as a tray-side cleaner contact portion, and a tray-side developing contact 46 as a tray-side developing contact portion whereby electric power is supplied to the developing cartridge 8. A power supply circuit board that forms the power supply device that supplies electric power to the charging contact 94, the cleaner contact 95, and the developing contact 96 is disposed inside a right side wall 2R illustrated in FIG. 3C so as to follow the right side wall 2R. That is, the right side wall 2R has such a thickness that it has a space in which the power supply device can be disposed. Various electrical component for other processing as well as electrical components of the power supply may be mounted in the power supply circuit board.

As illustrated in FIG. 3A, the cartridge tray 3 is provided so as to be movable in the third direction along a rail 41 provided in the apparatus body 2 after a front door 40 of the image forming apparatus 1 is open. The developing cartridges 8 (8Y, 8M, 8C, and 8K) can be individually replaced from the cartridge tray 3.

As illustrated in FIG. 4, the developing cartridges 8 (8Y, 8M, 8C, and 8K) are attached to and detached from four slots formed in the cartridge tray 3. In this example, the developing cartridge 8C is taken out. The photosensitive drums 4 (4Y, 4M, 4C, and 4K) are provided in the cartridge tray 3 so as to correspond to the developing cartridges 8 (8Y, 8M, 8C, and 8K). The cartridge tray 3 includes a charging roller which is a charging unit as a process unit acting on the photosensitive drums 4 (4Y, 4M, 4C, and 4K) and a cleaning roller 7 which is a cleaning unit. The details of the cartridge tray 3 will be described later.

The developing cartridges 8 (8Y, 8M, 8C, and 8K) each include a developing roller 6 which is a developer bearing member that develops an electrostatic latent image formed on the photosensitive drums 4 (4Y, 4M, 4C, and 4K) and a memory tag unit 80 to which a memory tag 81 as a memory medium is attached. The memory tag 81 is a contact-type IC chip having electrical contact portions, for example. The electrical contact portions of the memory tag 81 make contact with tray-side memory contacts 32 provided in the cartridge tray 3, whereby the memory tag 81 communicates with the image forming apparatus 1 and users can be informed of information such as a residual developer amount. The developing cartridge 8 and the memory tag unit 80 will be described later.

The image forming apparatus 1 further includes a control unit 43, a body-side metal terminal 9, and a display unit 42. The control unit 43 is electrically connected to the body-side metal terminal 9 and includes a processor such as a CPU and various memories. The control unit 43 is configured as a circuit board, for example, and a processor operates according to a program to execute various processes of the image forming apparatus 1. The control unit 43 processes information of the memory tag 81 of the developing cartridge 8 via the body-side metal terminal 9 and a tray-side metal terminal 47 provided in the cartridge tray 3. In this way, information on the developing cartridge 8 stored in the memory tag 81 such as a residual developer amount, for example, can be read and be displayed to users by the display unit 42 provided in the image forming apparatus 1. Moreover, the information can be written to the memory tag 81. Although description will be made using a term "metal terminal", the metal terminal may be read an electrical contact or an electrical contact portion, an electrode or an electrode portion, or an information delivery portion, and the like.

Image Forming Operation

Figure 5:
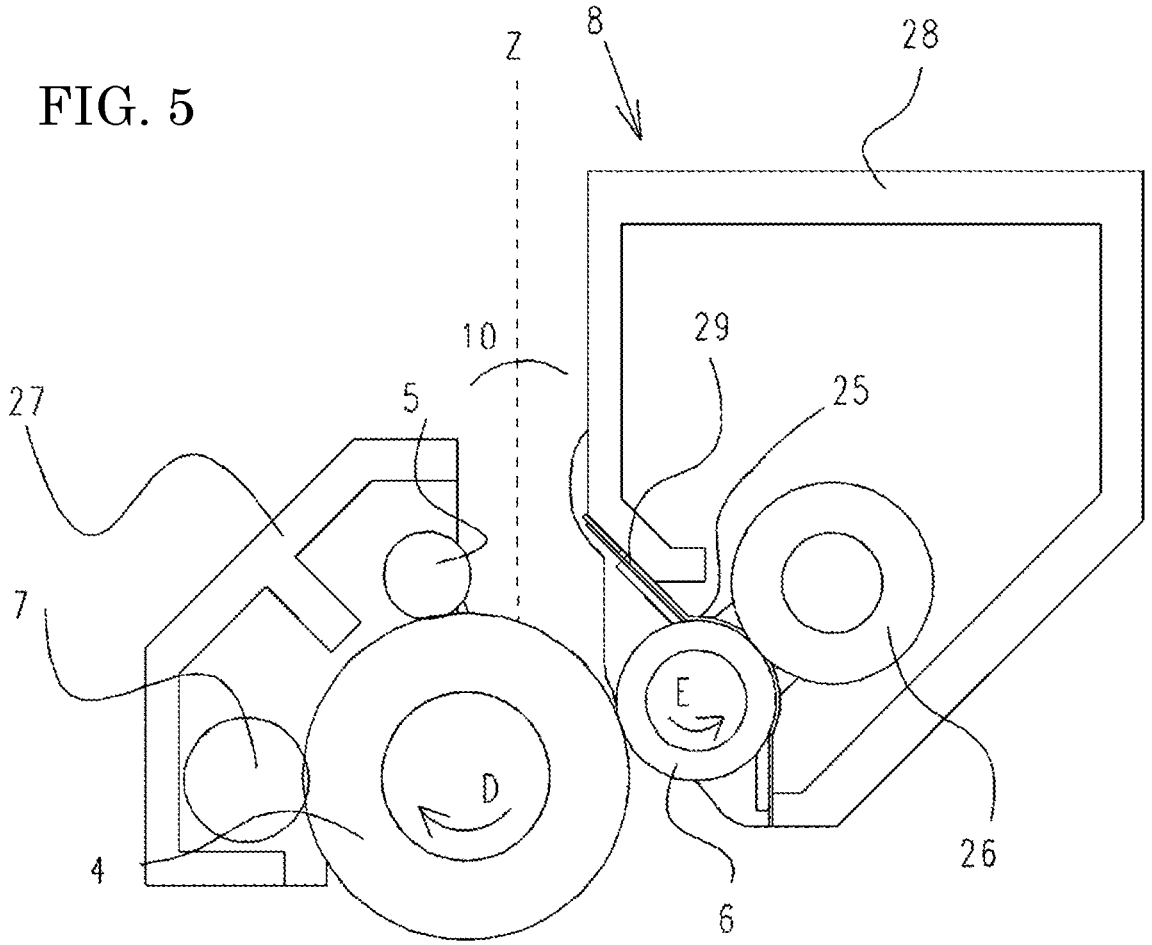
FIG. 5 is a cross-sectional schematic view of the cartridge tray and the developing cartridge according to Embodiment 1.

An image forming operation will be described using FIGS. 2 to 5. FIG. 5 is a partial cross-sectional schematic view of the cartridge tray 3 and the developing cartridge 8 according to the present embodiment.

An image forming operation for forming a full-color image is as follows. The cartridge tray 3 to which the developing cartridges 8 (8Y, 8M, 8C, and 8K) are attached is inserted in the apparatus body and the front door 40 is closed. When the front door 40 is closed, drum driving couplings 52 (52Y, 52M, 52C, and 52K) provided in the image forming apparatus 1 engage with drum driving input couplings 54 (54Y, 54M, 54C, and 54K) connected to the photosensitive drums 4 (4Y, 4M, 4C, and 4K) provided in the cartridge tray 3.

Drum driving gears 53 (53Y, 53M, 53C, and 53K) are rotated by motors and gears (not illustrated) of the image forming apparatus 1. As illustrated in FIG. 3B, a circuit board in which one or plural motors for driving a developing driving coupling 51 and the drum driving coupling 52 and the driver circuits thereof are provided is disposed inside a left side wall 2L so as to follow the left side wall 2L. That is, the left side wall 2L has such a thickness that it has a space in which the power supply device can be disposed. Various electrical component for other processing as well as electrical components of the power supply may be mounted in the circuit board.

The photosensitive drums 4 (4Y, 4M, 4C, and 4K) are rotated at a prescribed speed by the drum driving gear (a direction indicated by arrow D in FIGS. 2 and 5). The transfer belt 12 is also rotated at a speed corresponding to the speed of the photosensitive drums 4 (4Y, 4M, 4C, and 4K) (a direction indicated by arrow C in FIG. 2). At that time, the laser scanner unit LB is also driven. The surfaces of the photosensitive drums 4 (4Y, 4M, 4C, and 4K) are uniformly charged to a prescribed polarity and potential by the charging roller 5 in synchronization with driving of the laser scanner unit LB. The laser scanner unit LB scans and exposes the surfaces of the photosensitive drums 4 with a laser beam Z according to image signals of respective colors. In this way, electrostatic latent images corresponding to the image signals of the corresponding colors are formed on the surfaces of the photosensitive drums 4 (4Y, 4M, 4C, and 4K).

The electrostatic latent image formed on the photosensitive drum is developed by the developing roller 6 rotated at a prescribed speed (a direction indicated by arrow E in FIG. 5). By such an electrophotographic image forming process, a developer image of yellow corresponding to a yellow component of a full-color image is formed on the photosensitive drum 4Y. Similarly, developer images corresponding to magenta, cyan, and black of the full-color image are formed on the photosensitive drums 4M, 4C, and 4K, respectively.

On the other hand, recording media M are separated and fed one by one at a prescribed control timing. A distal end of a developer image on the circumferential surface of the photosensitive drum 4 moves to a transfer portion which is a point facing the transfer belt 12. The transfer belt 12 is conveyed at a prescribed control timing so that the rotation of the photosensitive drum 4 is synchronized with a timing at which the recording medium M is conveyed to the transfer portion and the print start positions in the transfer portion coincide with each other. The developer images on the photosensitive drums 4 are sequentially transferred to the recording medium M conveyed in a state of being electrostatically adsorbed to the transfer belt 12 by an electric field formed between the photosensitive drums 4 and the transfer roller 16. The recording medium M to which the developer images of the four colors are transferred is fixed by the fixing unit 21 and is discharged to the discharge tray 23 via the discharge unit 22.

Configuration of Cartridge Tray

Figure 6A:
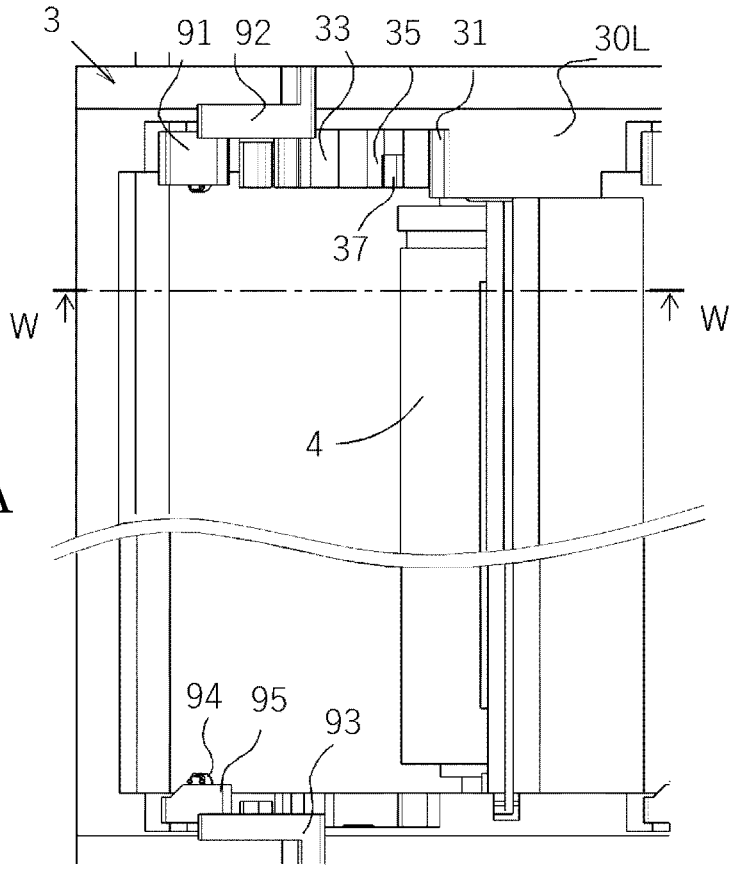
FIGS. 6A and 6B are respectively a diagram and a cross-sectional schematic view of the cartridge tray according to Embodiment 1.
Figure 6B:
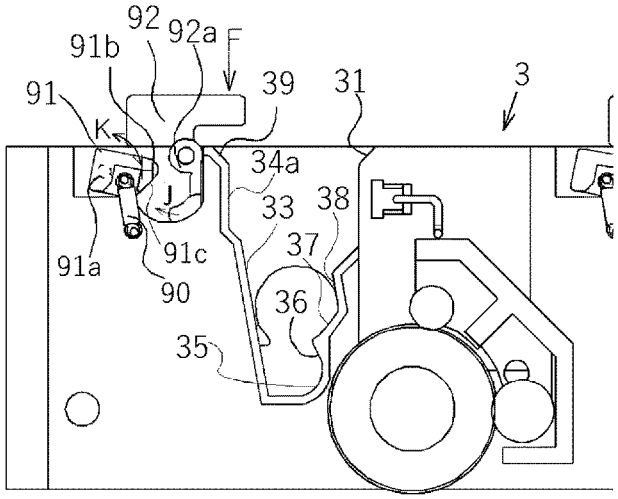
Figure 11A:
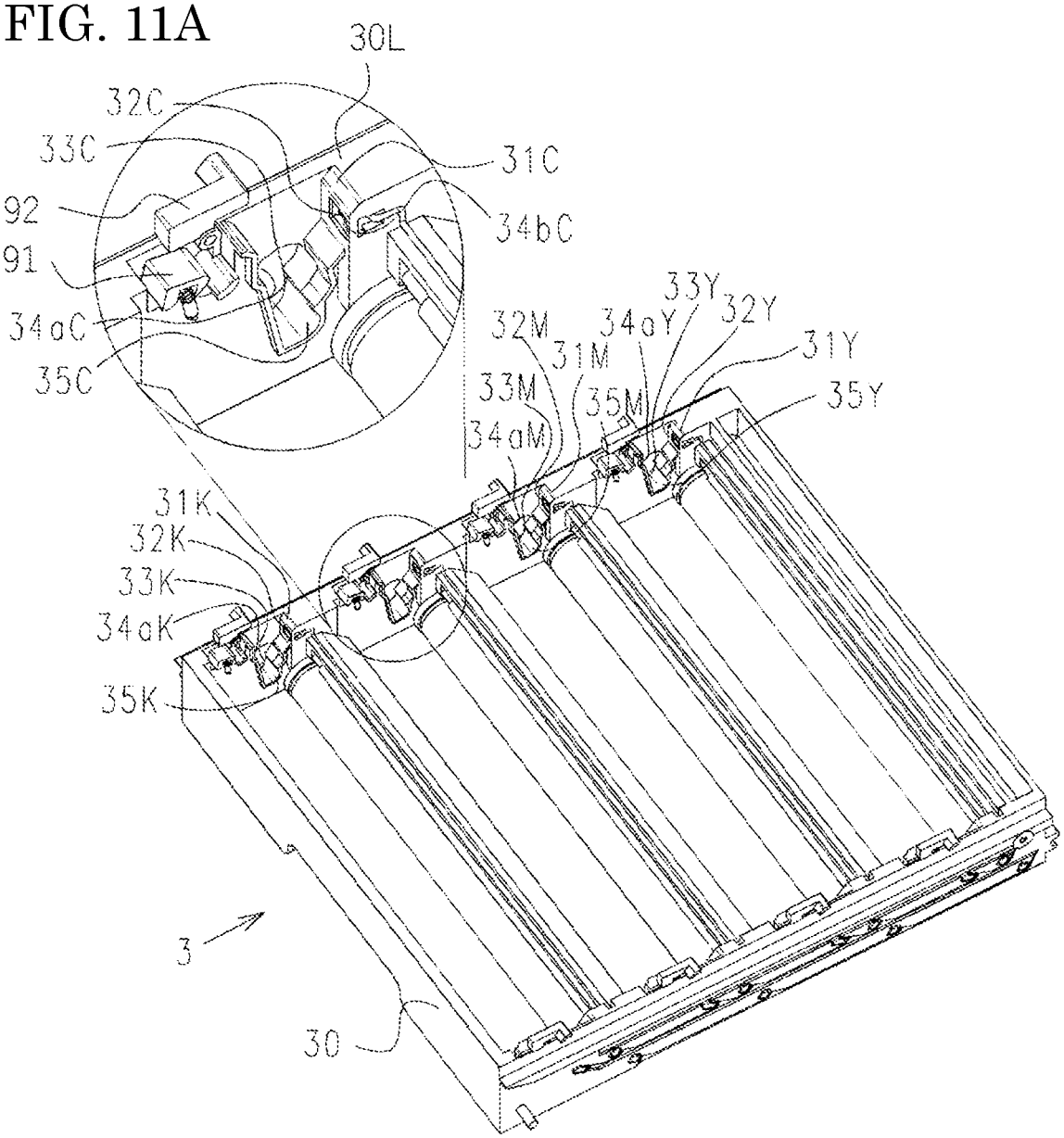
FIG. 11A is a perspective view of the cartridge tray according to Embodiment 1.
Figure 11B:
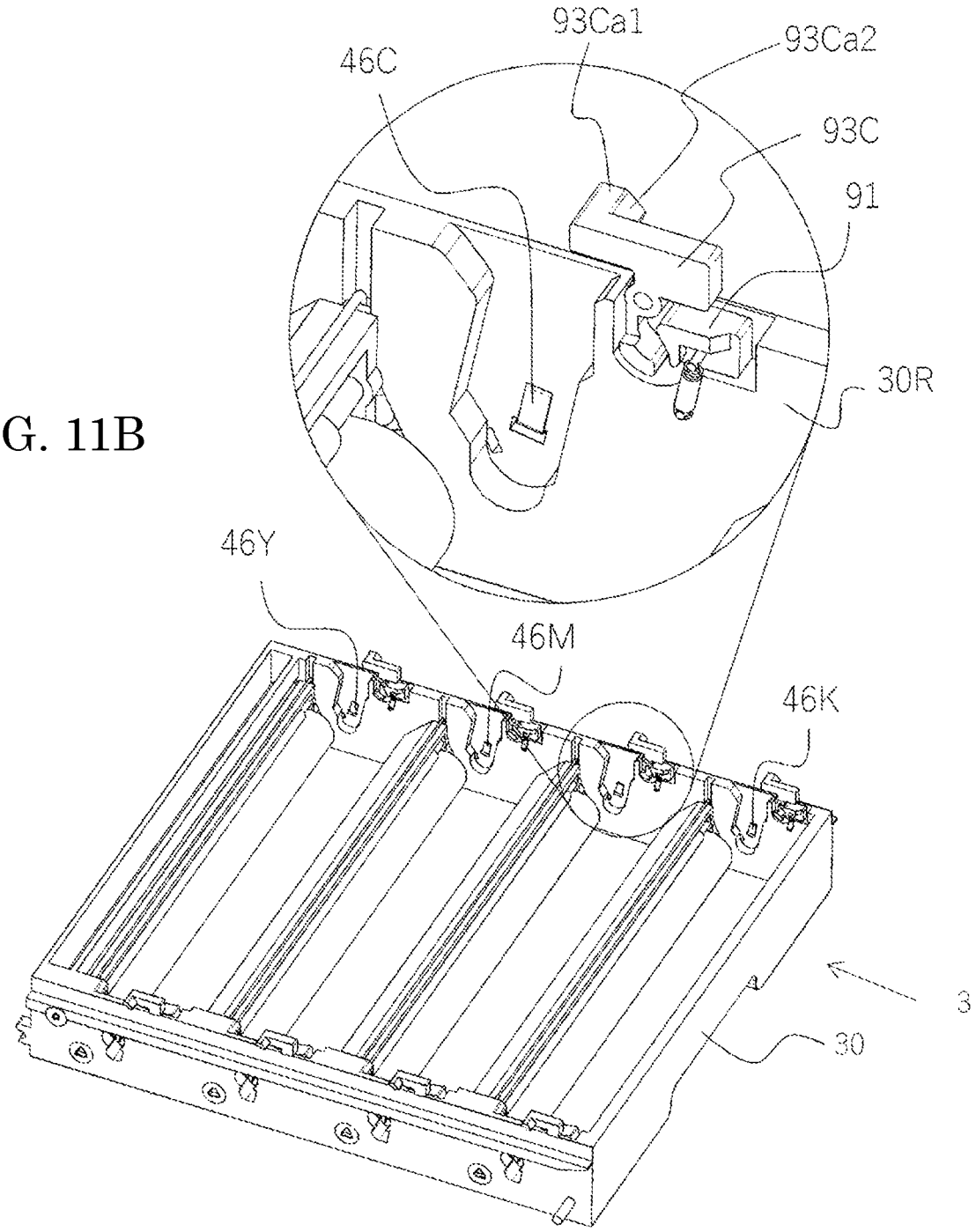
FIG. 11B is another perspective view of the cartridge tray according to Embodiment 1.

Next, a detailed configuration of the cartridge tray 3 will be described with reference to FIGS. 1, 5, 6A and 6B, 11A, 11B, and 12A to 12D. FIG. 1 is a perspective view of the cartridge tray 3 according to the present embodiment. FIGS. 6A and 6B are a diagram (FIG. 6A) and a cross-sectional schematic view (FIG. 6B) of the cartridge tray 3 according to the present embodiment. FIGS. 11A and 11B are enlarged perspective views around a developing cartridge fixing portion of the cartridge tray 3 according to the present embodiment. FIGS. 12A to 12D are enlarged perspective views of a right side surface of the cartridge tray 3 according to the present embodiment.

The cartridge tray 3 includes a tray frame 30, a tray penetration shaft 55, the photosensitive drum 4, the charging roller 5 as a charging unit, a cleaning frame 27 including a cleaning unit, and the like. The cartridge tray 3 includes the tray-side charging contact 44, the tray-side cleaner contact 45, and the tray-side developing contact 46 as tray-side process contacts, and the tray-side metal terminal 47.

As illustrated in FIG. 1, the tray frame 30 is a frame made up of four surfaces (four portions, four walls) including a tray right side surface (a tray right side portion, a tray right side wall) 30R, a tray left side surface (a tray left side portion, a tray left side wall) 30L, a tray front surface (a tray front side portion, a tray front side wall) 30F, and a tray rear surface (a tray rear side portion, a tray rear side wall) 30B. The tray right side surface 30R is a side surface (a side portion, a side wall) positioned on the outer side in the first direction of the cartridge tray 3 to cover the right side. Similarly, the tray left side surface 30L is a side surface (a side portion, a side wall) positioned on the outer side in the first direction of the cartridge tray 3 to cover the left side. A surface connecting the tray right side surface 30R and the tray left side surface 30L and positioned on the front side of the cartridge tray 3 is the tray front surface 30F and the surface positioned on the rear surface side is the tray rear surface 30B. That is, the tray front surface 30F connects the tray right side surface 30R and the tray left side surface 30L, and the tray front surface 30F is positioned on the front side of the cartridge tray 3. The tray rear surface 30B connects the tray right side surface 30R and the tray left side surface 30L, and the tray rear surface 30B is positioned on the rear surface side of the cartridge tray 3. The "right side" and the "left side" indicate the right-hand side and the left-hand side when seen from the user who tries to insert the cartridge tray 3 into the apparatus body. The description of left, right, front, and rear in the following description is an example only and does not limit the scope of the present invention. The tray right side surface 30R and the tray left side surface 30L which are two side surfaces (two side portions, two side walls) are provided to extend in the moving direction of the cartridge tray 3.

As illustrated in FIG. 1, the tray penetration shaft 55 is a penetration shaft supported by the tray right side surface 30R and the tray left side surface 30L and both ends thereof protrude further outward than the tray right side surface 30R and the tray left side surface 30L. Tray positioning portion 56 (56R and 56L) are provided on the rear surface sides of the tray right side surface 30R and the tray left side surface 30L. The tray penetration shaft 55 is supported by tray shaft engagement portions 57 (57R and 57L) of the apparatus body 2 illustrated in FIGS. 3A to 3C, and the tray positioning portion 56 is supported by a tray positioning shaft 24 of the apparatus body 2 illustrated in FIGS. 2 and 3A to 3C. In this way, the cartridge tray 3 and the apparatus body 2 are positioned. Furthermore, the photosensitive drum 4 is supported by the tray right side surface 30R and the tray left side surface 30L as will be described later, whereby the photosensitive drum 4 and the apparatus body 2 can be positioned with high accuracy.

As illustrated in FIGS. 1, 6A and 6B, the photosensitive drum 4 is supported by the tray right side surface 30R and the tray left side surface 30L and is rotatably attached to a rotating shaft extending in the first direction.

As illustrated in FIG. 5, the photosensitive drum 4 rotates in a direction indicated by arrow D during printing. As illustrated in FIG. 4 and the like, the drum driving input coupling 54 for transmitting driving force to the photosensitive drum 4 is provided in a driving side of the photosensitive drum 4.

The charging roller 5 is supported by the cleaning frame 27 so as to be able to rotate with respect to the rotating shaft extending in the first direction and to rotate following the photosensitive drum 4 in a contacting state. The cleaning frame 27 is supported by the tray right side surface 30R and the tray left side surface 30L. The tray-side charging contact 44 is provided on a surface of the cleaning frame 27 close to the tray right side surface 30R and the cleaning frame 27 is electrically connected to the charging roller 5. The tray-side charging contact 44 is exposed to the right side surface of the cartridge tray 3 and makes contact with the charging contact 94 of the apparatus body 2, whereby the charging roller 5 is electrically connected to the apparatus body 2. Electric power is supplied from a power supply unit. In this way, the surface of the photosensitive drum 4 is uniformly charged to a prescribed polarity and potential. Although the charging roller 5 is used as a charging unit in the present embodiment, the charging unit of the photosensitive drum 4 is not limited thereto, and another means such as a corona charger may be used.

The cleaning frame 27 provided in the tray frame 30 is a frame that stores the cleaning roller 7 as a cleaning unit. The cleaning roller 7 is supported by the cleaning frame 27 at a position contacting the photosensitive drum 4 and is rotatably attached to the rotating shaft extending in the first direction.

The tray-side cleaner contact 45 is provided in a surface of the cleaning frame 27 close to the tray right side surface 30R, and the cleaning frame 27 is electrically connected to the cleaning roller 7. The tray-side cleaner contact 45 is exposed to the right side surface of the cartridge tray 3 and makes contact with the cleaner contact 95 of the apparatus body 2, whereby the cleaning roller 7 is electrically connected to the apparatus body 2. Electric power is supplied from a power supply. In this way, a waste developer on the surface of the photosensitive drum 4 remaining without being transferred during printing is removed by the cleaning roller 7 effectively. Although the cleaning roller 7 is used as a cleaning unit in the present embodiment, another means such as a rubber blade or a sheet may be used. The cleaning unit may not necessarily be provided.

As illustrated in FIGS. 11A and 11B, a developing roller positioning unit 35, a developing pressing member 91, a separation member 92 are provided on both the tray right side surface 30R and the tray left side surface 30L so as to correspond to each of the plurality of developing cartridges.

Figure 7:
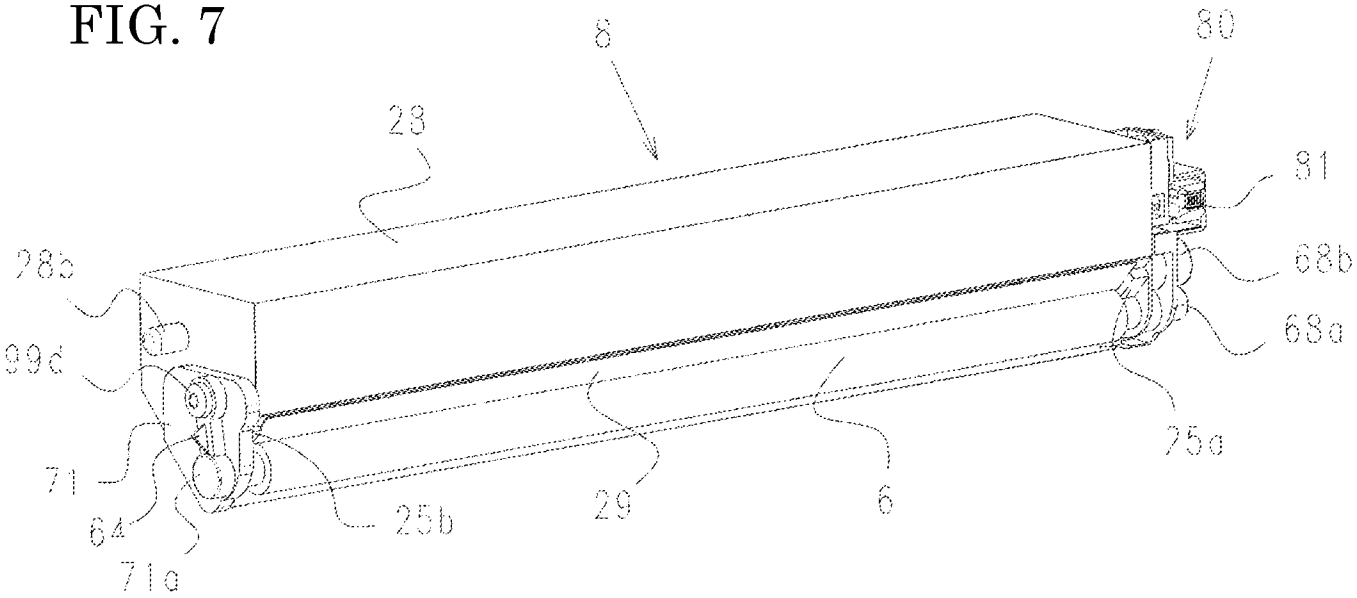
FIG. 7 is a perspective view illustrating a non-driving side of the developing cartridge according to Embodiment 1.
Figure 8A:
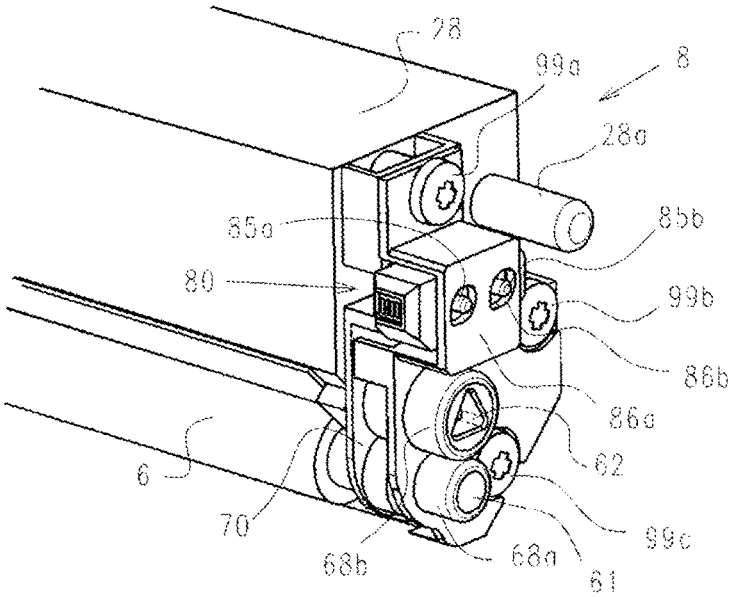
FIGS. 8A and 8B are respectively an enlarged perspective view and a diagram of a driving side of the developing cartridge according to Embodiment 1.
Figure 8B:
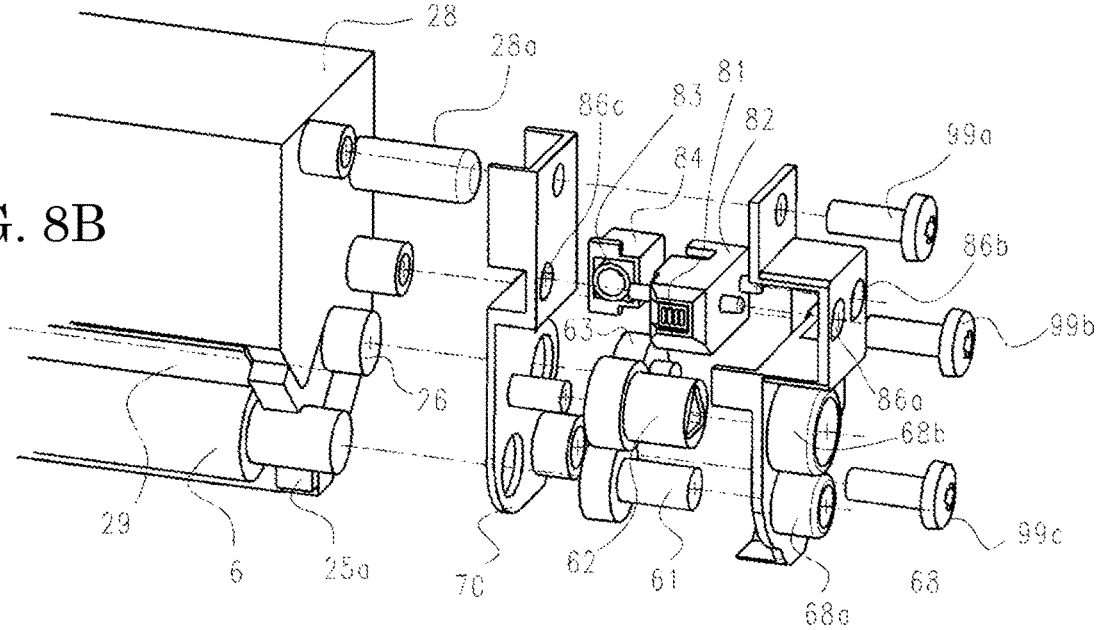

The developing roller positioning unit 35 supports a developing roller cover positioning unit 68*a* and a developing roller bearing positioning unit 71*a* disposed on the same axis as the developing roller 6 of the developing cartridge 8 illustrated in FIGS. 7, 8A, and 8B.

The developing pressing member 91 is rotatably supported by the tray right side surface 30R and the tray left side surface 30L. The developing pressing member 91 makes contact with developing rotation stopping boss 28*a* and 28*b* provided on both side surfaces of the developing cartridge 8 illustrated in FIGS. 7, 8A, and 8B to support the developing cartridge 8 in cooperation with the developing roller positioning unit 35. In this case, the developing pressing member 91 is pulled in a direction indicated by arrow H by a developing pressing spring 90 whereby the developing roller 6 makes contact with the photosensitive drum 4.

Figure 10A:
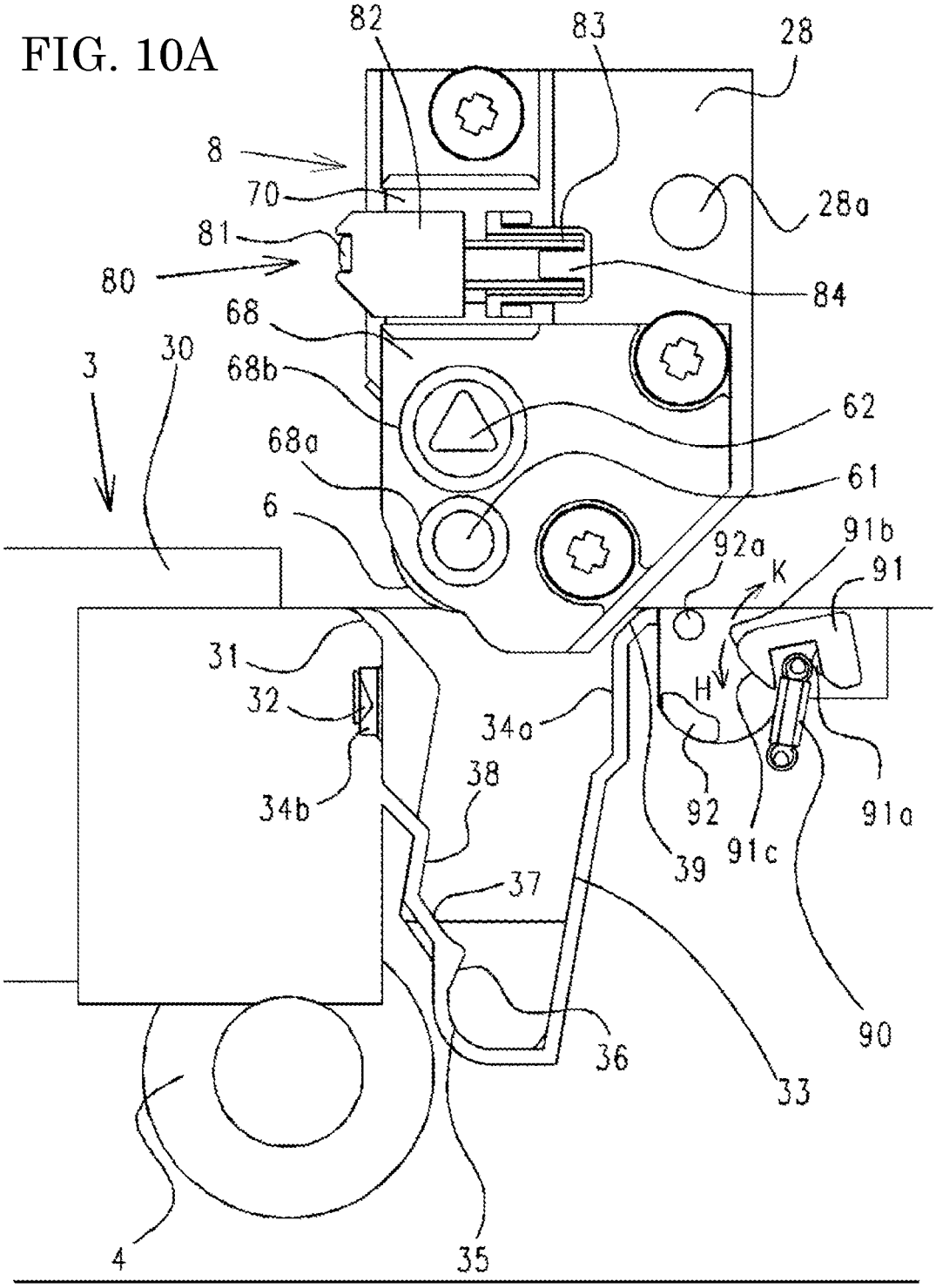
FIG. 10A is a cross-sectional schematic view illustrating the behavior during attachment of the developing cartridge according to Embodiment 1.
Figure 10B:
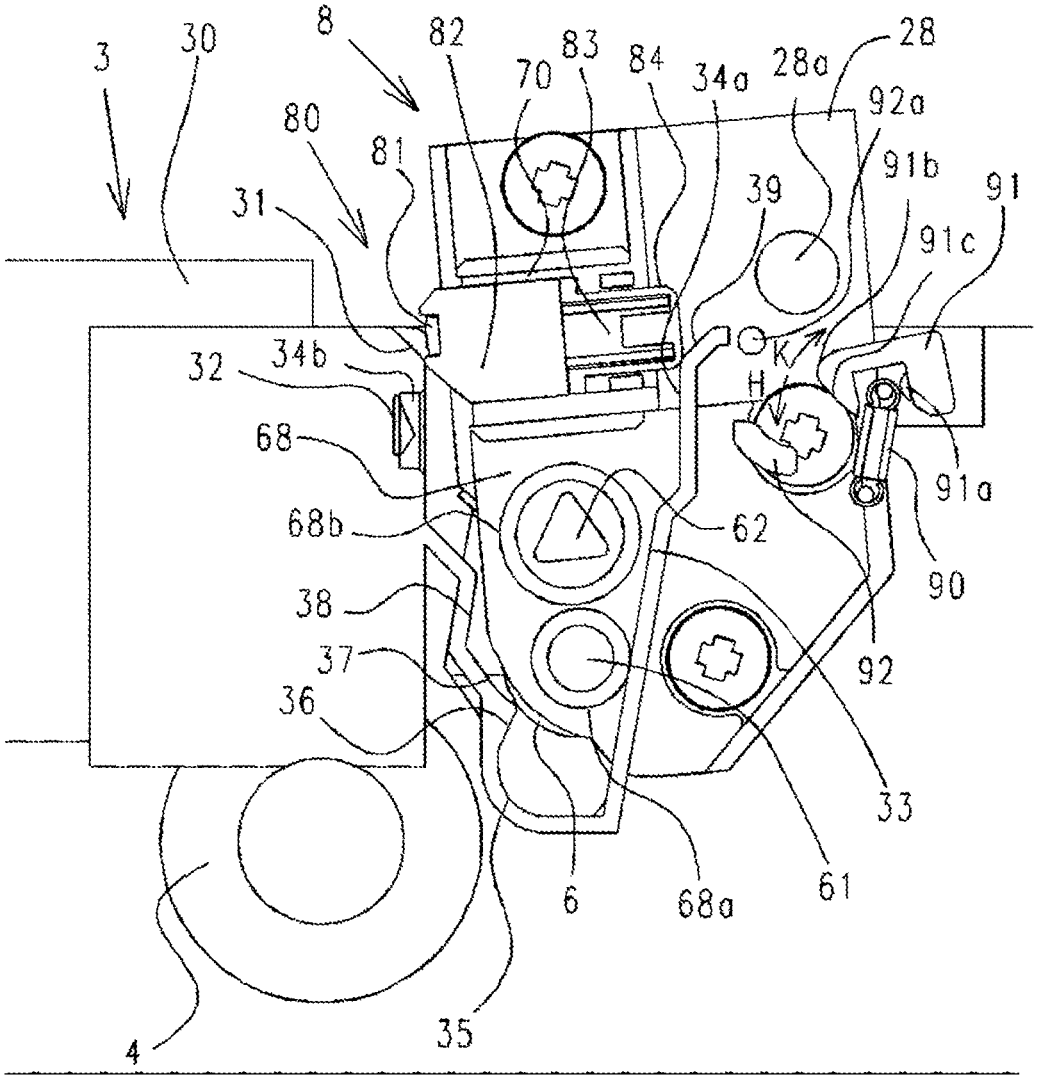
FIG. 10B is a continuation of a cross-sectional schematic view illustrating the behavior during attachment of the developing cartridge according to Embodiment 1.
Figure 10C:
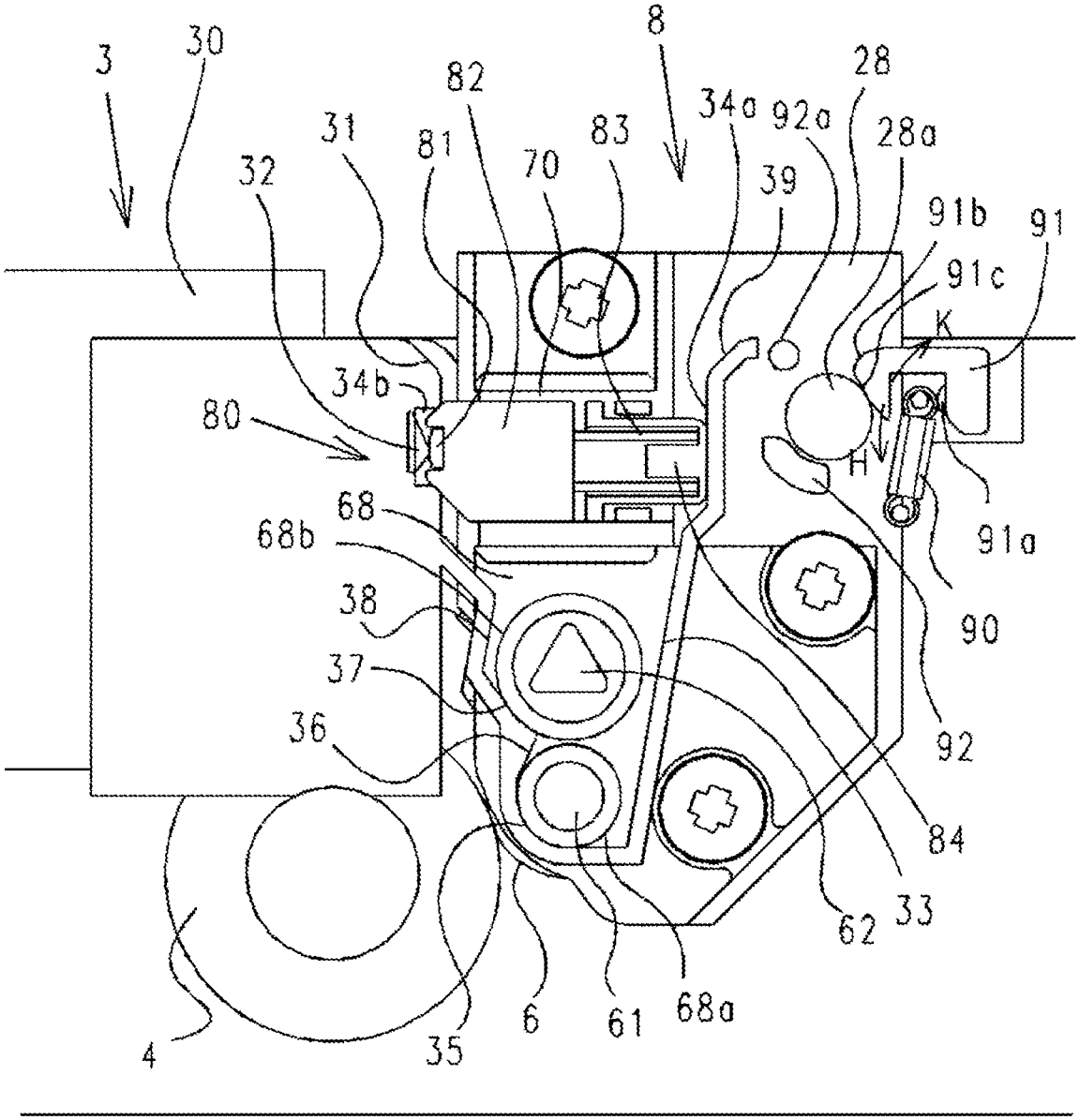
FIG. 10C is a continuation of a cross-sectional schematic view illustrating the behavior during attachment of the developing cartridge according to Embodiment 1.
Figure 10D:
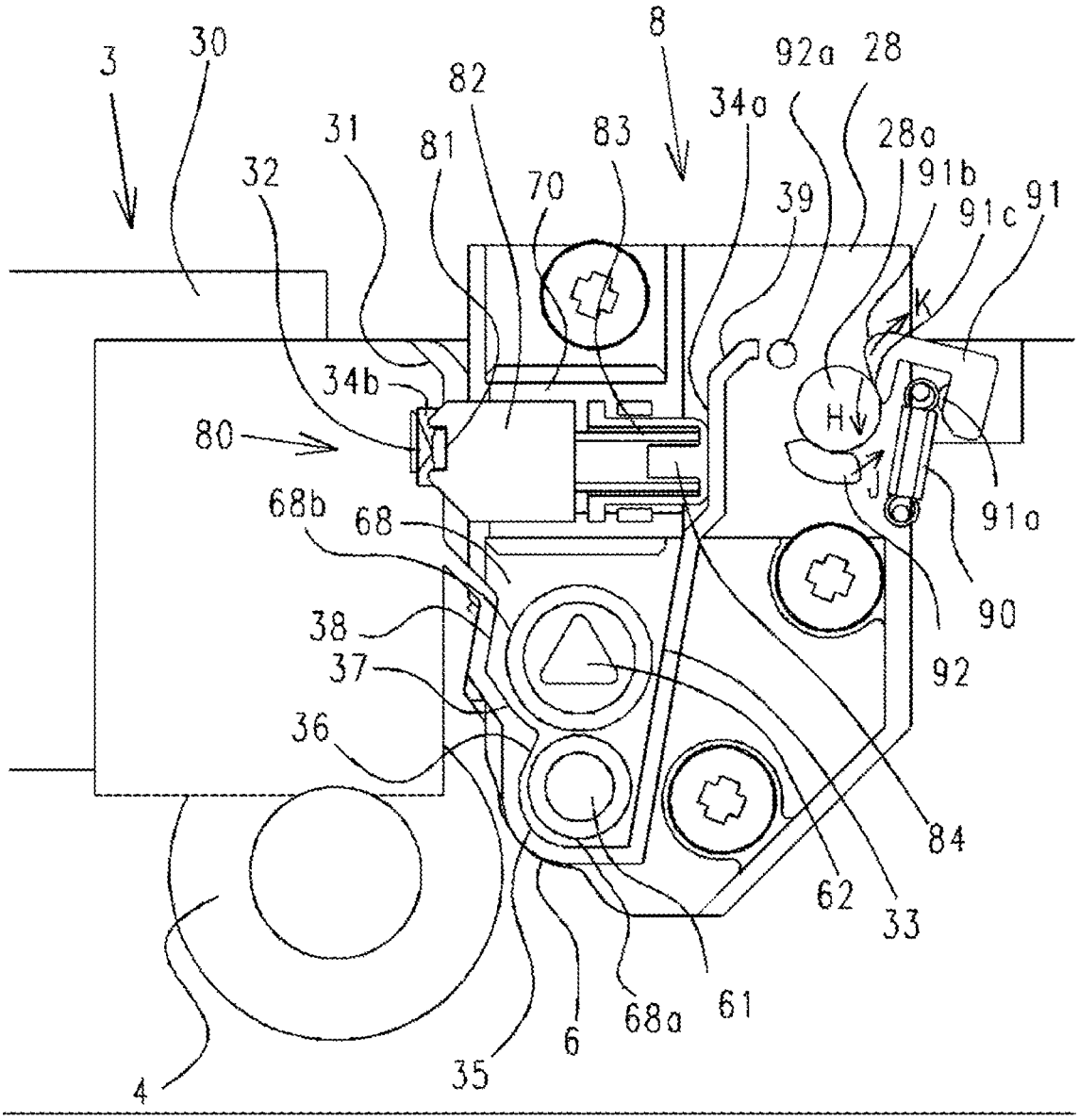
FIG. 10D is a continuation of a cross-sectional schematic view illustrating the behavior during attachment of the developing cartridge according to Embodiment 1.

The separation member 92 is rotatably supported by the tray right side surface 30R and the tray left side surface 30L and receives force from a separation and pressing member 60 of the apparatus body 2 whereby the separation member 92 rotates in a direction indicated by arrow J in FIGS. 6B and 10D. In this way, the separation member 92 makes contact with the developing rotation stopping bosses 28*a* and 28*b* provided at both ends of a developer storage frame 28, moves the developing cartridge 8 while resisting the tension of the developing pressing spring 90, and separates the developing roller 6 and the photosensitive drum 4 from each other. When printing is not performed, the developing roller 6 and the photosensitive drum 4 are separated from each other whereby consumption of the service life of the developing cartridge 8 can be suppressed.

The tray-side developing contact 46 is provided on the tray right side surface 30R. One end in the first direction of the tray-side developing contact 46 illustrated in FIG. 11B is provided at a position corresponding to a developing roller contact 64 of the developing cartridge 8. The other end in the first direction of the tray-side developing contact 46 illustrated in FIG. 1 is exposed to the right side surface of the cartridge tray 3. In this way, when the cartridge tray 3 is at a printing position, the cartridge tray 3 makes contact with the developing contact 96 of the apparatus body 2. As a result, the developing cartridge 8 and the apparatus body 2 are electrically connected. Electric power is supplied from the power supply unit.

The tray-side memory contact 32 as a tray-side memory contact portion illustrated in FIG. 11A is provided at a position corresponding to the memory tag 81 when the developing cartridge 8 is housed in the cartridge tray 3. In this case, the tray-side memory contact 32 makes contact with an electrical contact portion of the memory tag 81. The tray-side memory contact 32 is connected to the tray-side metal terminal 47 provided on a non-driving-side side surface of the tray frame 30 by wiring portions (not illustrated). The tray-side metal terminal 47 is exposed to the right side surface of the cartridge tray 3 and makes contact with the body-side metal terminal 9 of the apparatus body 2 when the cartridge tray 3 is at a printing position. In this way, the apparatus body 2 and the memory tag 81 are electrically connected.

Configuration of Developing Cartridge

Next, the developing cartridge 8 will be described with reference to FIGS. 5, 7, 8A, and 8B. FIG. 7 is a perspective view when seen from a non-driving side of the developing cartridge 8 according to the present embodiment. FIGS. 8A and 8B are respectively a perspective view (FIG. 8A) on a driving side of the developing cartridge 8 according to the present embodiment and a diagram (FIG. 8B) illustrating an exploded state. As illustrated in the drawings, the developing cartridge 8 includes the developer storage frame 28, the developing roller 6, an end sealing member 25, a stirring roller 26, a developer regulation blade 29, a cartridge bearing (driving side) 70, a cartridge bearing (non-driving side) 71, a cartridge side cover 68, a developing roller gear 61, a driving input coupling gear 62, a stirring roller gear 63, a developing roller contact 64, and the memory tag unit 80.

The developer storage frame 28 is a casing capable of containing a developer and supplies a developer to the developing roller 6. The stirring roller 26 has a function of stirring a developer in the developer storage frame 28 and applying a developer to the developing roller 6. The developing roller 6 and the stirring roller 26 are rollers that can rotate with respect to the rotating shaft extending in the first direction. The developing roller 6 and the stirring roller 26 include a roller body and a roller shaft. For example, rubber or a sponge member having elasticity is used as a material of the roller body. Metal or a conductive resin is used as a material of the roller shaft. As illustrated in FIGS. 7 and 8A, the developing roller 6 and the stirring roller 26 are rotatably supported by the cartridge bearing (driving side) 70 and the cartridge bearing (non-driving side) 71. The cartridge bearing (driving side) 70 is fastened to the developer storage frame 28 together with the cartridge side cover 68 and is fixed by screws 99*a* to 99*c*.

The cartridge bearing (non-driving side) 71 is fixed to the developer storage frame 28 by a screw 99*d*. As illustrated in FIG. 8B, roller shafts of the developing roller 6 and the stirring roller 26 pass through the cartridge bearing (driving side) 70 and are connected to the developing roller gear 61 and the stirring roller gear 63. The developing roller gear 61 transmits the driving force from the body to the developing roller 6 and the stirring roller gear 63 transmits the driving force from the body to the stirring roller 26.

The driving input coupling gear 62 is a gear rotatably supported by the cartridge bearing (driving side) 70 and the cartridge side cover 68. The driving input coupling gear 62 has an engagement coupling portion for receiving driving force from the body and transmits the driving force from the body to the developing roller gear 61 and the stirring roller gear 63. The engagement coupling may have an arbitrary shape as long as driving force is transmitted. In this example, the developing cartridge has a hole having a triangular recess shape. One body-side engagement coupling portion has a triangular rib having a convex shape corresponding to the triangular recess shape.

The developer regulation blade 29 is a blade that makes contact with the developing roller 6 to regulate the thickness of a developer borne on the developing roller 6. The developer regulation blade 29 is fixed to the developer storage frame 28 by screws or the like and manages a contact angle and an entrance amount with respect to the developing roller 25 so that the thickness of the developer on the developing roller is regulated constantly. A SUS sheet or a rubber member is generally used as a material of the developer regulation blade 29.

The developing roller contact 64 is a metallic member provided in the cartridge bearing (non-driving side) 71 and is exposed to a non-driving-side side surface of the developing cartridge 8 and electrically connected to the developing roller 6 and the developer regulation blade 29. An exposed portion of the developing roller contact 64 has a spring property in the first direction. When the developing cartridge 8 is attached to the cartridge tray 3, the exposed portion is deformed toward the inner side of the developing cartridge in the first direction and makes contact with the tray-side developing contact 46 of the cartridge tray 3 with a prescribed contact pressure.

In the present embodiment, the developing roller contact 64 is connected to both the developing roller 6 and the developer regulation blade 29. However, the developing roller contact 64 may be formed of a plurality of members. For example, the developing roller contact 64 may be formed of a member connecting to the developing roller 6 only and a member connecting to the developer regulation blade 29 only. The tray-side developing contact 46 of the cartridge tray 3 and the developing contact 96 of the apparatus body 2 may be independent members corresponding to the developing roller 6 and the developer regulation blade 29, respectively. In this way, the developing roller 6 and the developer regulation blade 29 are connected independently to the apparatus body 2 and receive different voltages.

The cartridge side cover 68 rotatably supports one set of ends of the developing roller gear 61 and the driving input coupling gear 62. The cartridge side cover 68 includes the developing roller cover positioning unit 68*a* that makes sliding contact with a guide and a fixing portion provided in the cartridge tray 3 when the developing cartridge 8 is attached to the cartridge tray 3, and a driving input cover positioning unit 68*b*. The developing roller cover positioning unit 68*a* has the same shaft as the developing roller 6 and the developing roller gear 61 and has a circumferential outer shape. The driving input cover positioning unit 68*b* has the same shaft as the driving input coupling gear 62 and a circumferential outer shape (a protruding portion).

As understood from FIGS. 8A and 8B, an end (an outermost shell) of the cartridge side cover 68 in the first direction (the longitudinal direction) is positioned closer to the outer side than the developing roller cover positioning unit 68*a* which is a protruding portion. In other words, it is possible to obtain an advantage that the size of the developing cartridge 8 can be further increased than when the memory tag unit 80 is disposed closer to the inner side in the longitudinal direction than the developing roller cover positioning unit 68*a*.

As described above, due to the developing roller cover positioning unit 68*a*, the driving input cover positioning unit 68*b*, and the developing rotation stopping boss (driving side) 28*a* provided in the developer storage frame 28, the developing cartridge 8 is positioned and fixed after being attached to the cartridge tray 3.

As illustrated in FIG. 7, on the non-driving side of the developing cartridge 8, due to the cartridge bearing (non-driving side) 71 and the developing rotation stopping boss (non-driving side) 28*b* of the developer storage frame 28, the developing cartridge 8 makes sliding contact with the cartridge guide provided in the cartridge tray 3 and attachment is completed. Similarly to the driving side, the bosses have a circumferential shape and the developing cartridge is smoothly guided. The developing roller bearing positioning unit 71*a* is disposed on the shaft of the developing roller 6, which is the same as the developing roller gear 61 and the developing roller cover positioning unit 68*a*. The developing rotation stopping boss (non-driving side) 28*b* is the same shaft as the developing rotation stopping boss (driving side) 28*a*.

Configuration of Memory Medium

Figure 9A:
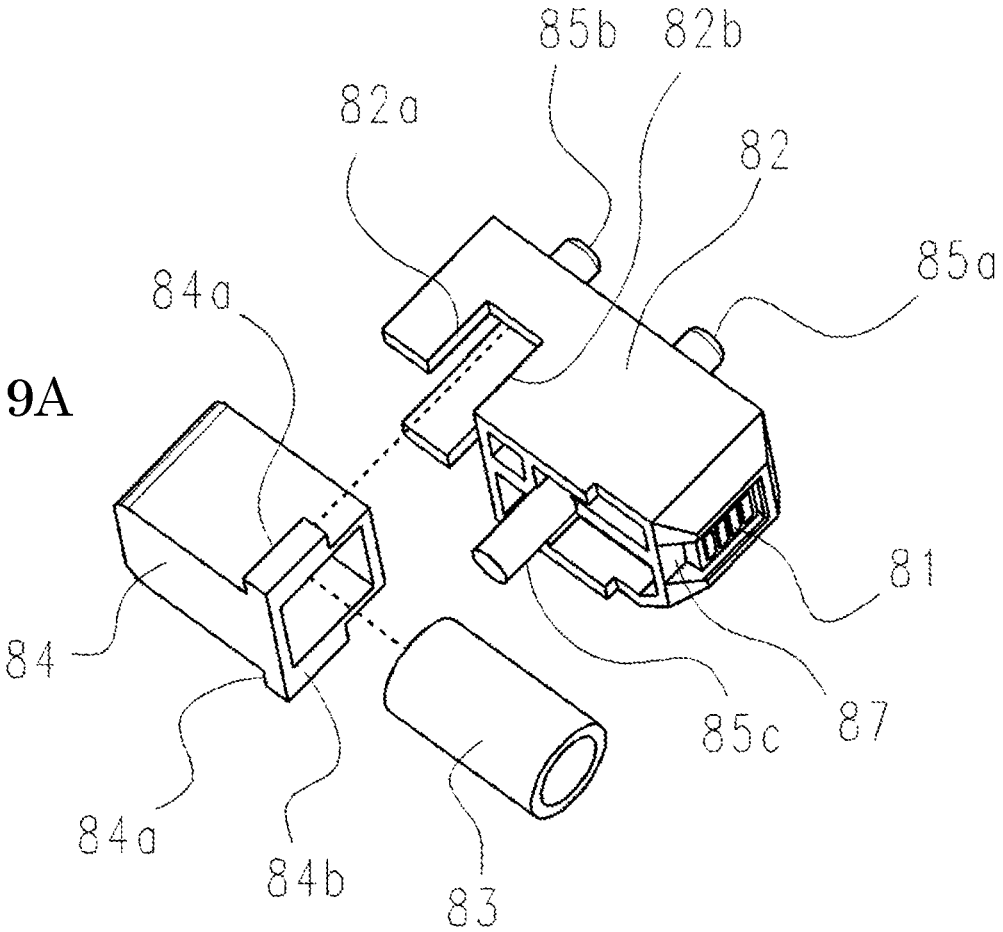
FIGS. 9A and 9B are diagrams of a memory tag unit of the developing cartridge according to Embodiment 1.
Figure 9B:
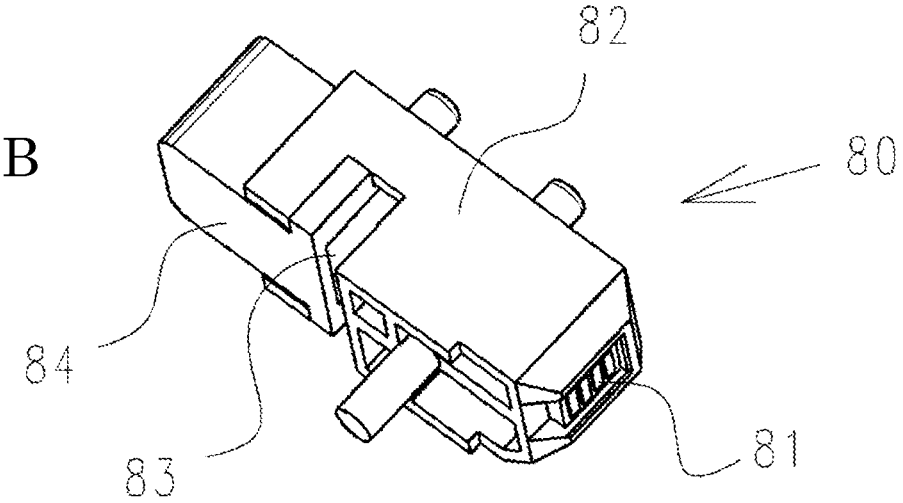

A configuration of the memory medium storing the information on the developing cartridge 8 will be described with reference to FIGS. 9A and 9B. The developing cartridge 8 has the memory tag unit 80. As illustrated in FIG. 9A, the memory tag unit 80 includes the memory tag 81, the memory tag pressing member 82, a memory tag pressing spring 83, and a pressing spring receiving member 84. The memory tag 81 stores information related to the developing cartridge 8.

The memory tag pressing member 82 has a memory attachment groove 87 for attaching and fixing the memory tag 81 and fixes the memory tag 81 by an arbitrary method such as adhesion, a double-sided tape, or heat caulking. As illustrated in FIG. 9B, the memory tag pressing member 82, the memory tag pressing spring 83, and the pressing spring receiving member 84 form the memory tag unit 80 as an integrated unit.

The memory tag pressing spring 83 is a compression spring and makes contact with a spring receiving surface (not illustrated) of the memory tag pressing member 82 and a spring receiving surface (not illustrated) of the pressing spring receiving member 84, and a compressed state is created from a natural state of spring. By the spring force of the memory tag pressing spring 83, a spring receiving portion regulation portion 82*a* of the memory tag pressing member 82 and a spring receiving member regulating portion 84*a* of the pressing spring receiving member 84 make contact with each other whereby the memory tag unit is held as an integrated unit. An elastic member other than the compression spring may be used. The memory tag unit 80 can be pushed further in the compression direction of the memory tag pressing spring 83 than the state of FIG. 9B. That is, the memory tag pressing spring 83 can be compressed to a position at which the spring receiving portion regulation portion 82*b* of the memory tag pressing member 82 makes contact with the spring receiving member regulating portion 84*b* of the pressing spring receiving member 84.

The memory tag pressing member 82 has attitude regulation bosses 85 (85*a*, 85*b*, and 85*c*). As illustrated in FIGS. 8A and 8B, when the memory tag unit 80 is assembled with the developing cartridge 8, the memory tag unit 80 is assembled so as to be inserted into the cartridge bearing (driving side) 70 and the cartridge side cover 68 in the longitudinal direction whereby movement in the first direction which is the longitudinal direction is regulated. In this case, the attitude regulation bosses 85*a* and 85*b* are inserted into attitude regulation holes 86*a* and 86*b* of the cartridge side cover 68, and the attitude regulation boss 85*c* is inserted into an attitude regulation hole 86*c* of the cartridge bearing (driving side) 70.

A boss diameter of the attitude regulation boss 85 is designed to be larger than a hole diameter of the attitude regulation hole 86. For example, when the boss has a circumference having a diameter of φ3 mm and the hole has a diameter of φ8 mm, a circumferential boss can move with a clearance of φ5 mm. In this way, the movement of the memory tag unit 80 in the second and third directions is regulated with a certain amount of clearance by the attitude regulation bosses 85 (85*a*, 85*b*, and 85*c*) and the attitude regulation holes 86 (86*a*, 86*b*, and 86*c*).

In this example, since the memory tag 81 is fixed to the memory tag pressing member 82, the attitude regulation boss 85 is provided in the memory tag pressing member 82 so that component tolerance becomes advantageous during positioning with the cartridge tray 3. However, the attitude regulation boss 85 may be provided in the pressing spring receiving member 84. How to make a gap in the first, second, and third directions for regulating the movement of the memory tag unit 80 and a relationship between the attitude regulation boss 85 and the attitude regulation hole 86 may be adjusted so that the engagement between the cartridge tray 3 and the memory tag unit 80 to be described later is realized smoothly. For example, the shape of the attitude regulation boss 85 and the attitude regulation hole 86 may not necessarily be a perfect circle.

The memory tag unit 80 is configured such that the positions in the first, second, and third directions are regulated with a certain amount of clearance by the cartridge bearing (driving side) 70 and the cartridge side cover 68. However, there is no limitation to the configuration of the present embodiment as long as the memory tag unit 80 can be moved in an arbitrary direction in the developing cartridge.

Although the memory tag unit 80 is provided on the driving side of the developing cartridge 8 in the present embodiment, the memory tag unit 80 may be provided on the non-driving side.

Attachment of Developing Cartridge to Cartridge Tray

The behavior when the developing cartridge 8 is attached to the cartridge tray 3 according to the present embodiment will be described with reference to the cross-sectional schematic views of FIGS. 10A to 10D. The drawings are cross-sectional schematic views of the driving-side side surface of the developing cartridge 8 and the corresponding cartridge tray 3.

FIG. 10A is a cross-sectional schematic view immediately before the developing cartridge 8 is inserted into an arbitrary slot of the cartridge tray 3 in a state of being drawn out from the apparatus body 2. In the state of FIG. 10A, the cartridge tray 3 is in a state in which the developing cartridge 8 of FIGS. 6A and 6B is not present. In this case, the developing pressing member 91 is in a state in which the developing pressing member 91 is pulled by the developing pressing spring 90 and the position is regulated by the cartridge tray 3. The developing cartridge 8 is in the state of FIGS. 7 and 8A, and the memory tag unit 80 is in a state in which the position is regulated within the range of clearance between the attitude regulation holes 86 (86*a*, 86*b*, and 86*c*) of the developing cartridge 8 and the attitude regulation bosses 85 (85*a*, 85*b*, and 85*c*) of the memory tag unit 80.

FIG. 10B is a cross-sectional schematic view of a state in which the developing cartridge 8 is being attached to the cartridge tray 3. In this drawing, the developing roller cover positioning unit 68*a* of the developing cartridge 8 is in contact with the cartridge guide portion 33 of the cartridge tray 3, and the memory tag pressing member 82 and the pressing spring receiving member 84 of the memory tag unit 80 are in contact with the memory guide portion 31 and the receiving member guide portion 39 of the cartridge tray 3, respectively. In the attachment state of FIG. 10B, the developing roller cover positioning unit 68*a* of the developing cartridge 8 is guided to the developing roller positioning unit 35 of the cartridge tray 3 by the guide portions of the cartridge tray 3 (the memory guide portion 31, the cartridge guide portion 33, the developing roller positioning guide portion 36, the driving input guide portion 38, and the receiving member guide portion 39).

Even when an insertion trajectory when attaching the developing cartridge 8 is different from user to user, the developing roller cover positioning unit 68*a* and the driving input cover positioning unit 68*b* make contact with the guide portions (the memory guide portion 31, the cartridge guide portion 33, the developing roller positioning guide portion 36, the driving input guide portion 38, and the receiving member guide portion 39), whereby the developing cartridge 8 is smoothly guided to the state of FIG. 10C which is an attachment completion position.

In the state of FIG. 10B, an inclined surface formed on the memory guide portion 31 and the receiving member guide portion 39 of the cartridge tray 3 makes contact with an inclined surface formed on the memory tag pressing member 82 and the pressing spring receiving member 84 of the memory tag unit 80. The developing cartridge 8 is guided to the state of FIG. 10C while the memory tag unit 80 is compressed according to an attachment operation of the developing cartridge 8. In FIGS. 10A to 10B, the memory tag unit 80 is guided with the position being guided by the attitude regulation boss and the attitude regulation hole (which are not illustrated).

FIG. 10C is a cross-sectional schematic view of a state in which the developing cartridge 8 is completely attached to the cartridge tray 3. In the state of FIG. 10C, the developing roller cover positioning unit 68*a* and the driving input cover positioning unit 68*b* of the developing cartridge 8 are in contact with the developing roller positioning unit 35 and a driving input positioning unit 37 of the cartridge tray 3.

After the developing rotation stopping boss 28*a* of the developing cartridge 8 makes contact with an arc surface of a rotation stopping boss introducing portion 91*b* provided in the developing pressing member 91 of the cartridge tray 3, the developing rotation stopping boss 28*a* rotates the developing pressing member 91 in a direction indicated by arrow K according to the attachment operation of the developing cartridge 8 and makes contact with a cartridge pressing portion 91*c*. The developing cartridge 8 is pressed by the spring force of the developing pressing spring 90 with the developing rotation stopping boss 28*a* disposed therebetween, the developing roller cover positioning unit 68*a* and the driving input cover positioning unit 68*b* make contact with the cartridge guide portion 33 and are stably positioned at the position of FIG. 10C. In this way, the developing roller 6 and the photosensitive drum 4 make contact with each other and printing can be performed. In the state of FIG. 10C, the developing rotation stopping boss 28*a* is not in contact with the separation member 92 and a gap is formed therebetween.

As illustrated in FIG. 10C, the pressing spring receiving member 84 of the memory tag unit 80 and a memory fixing portion 34*a* of the cartridge guide portion 33 make contact with each other, and the memory tag 81 is pressed toward the tray-side memory contact 32 by the spring force of the memory tag pressing spring 83. The position of the memory tag pressing member 82 that fixes the memory tag 81 is regulated by a memory fixing recess 34*b* formed in the tray-side memory contact 32 of the cartridge guide portion 33. That is, although the memory tag unit 80 has a clearance with respect to the developing cartridge 8 before attachment, the memory tag unit 80 is fitted by the memory fixing portion 34*a* and the memory fixing recess 34*b* of the cartridge guide portion 33 and a state in which the movement in the second and third directions is regulated is created. In the longitudinal direction which is the first direction, the memory tag pressing member 82 is fitted to the memory fixing recess 34*b*, and the movement of the memory tag unit 80 is regulated.

In this way, an electrical contact portion of the memory tag 81 is fixed by making contact with the tray-side memory contact 32, and the memory tag unit 80 is completely attached. The contact pressure of the contact portion of the memory tag 81 may be such pressure that stable positioning is realized and may be determined according to a recess shape formed in the tray-side memory contact 32 or the shape of the memory tag pressing member 82. Alternatively, rather than a configuration in which the memory tag pressing member 82 abuts on a recess, the position may be determined by the contact between the memory tag 81 and the tray-side memory contact 32.

FIG. 10D is a cross-sectional schematic view of a state in which the developing roller 6 of the developing cartridge 8 is separated from the developing pressing member 4 of the cartridge tray 3. A cartridge guide in the present embodiment is configured such that a positional relationship between the developing roller 6 and the photosensitive drum 4 is changed between a contact state and a separation state in order to extend the service life of the components thereof. As illustrated in FIGS. 6A and 6B, separation members 92 and 93 are provided on the driving side and the non-driving side of the cartridge tray 3 in order to separate the developing cartridge 8. As illustrated in the cross-section along W-W in FIG. 6B, the driving-side separation member 92 is attached so as to be rotatable about a separation member rotation center 92*a*. The non-driving-side separation member 93 has a rotation center at a symmetric position with respect to the separation member rotation center 92*a* and performs the same operation as the separation member rotation center 92*a*, and the description thereof will be omitted. The separation member 92 receives a separation member pressing force F by the pressing of a separation member (not illustrated). In this way, the separation member 92 can rotate in a direction indicated by arrow J.

FIG. 10D is a diagram illustrating a state in which the separation member 92 is rotated in the direction indicated by arrow J by the separation member pressing force F from the state of FIG. 10C. In this case, the developing rotation stopping boss (driving side) 28*a* of the developing cartridge 8 rotates the developing pressing member 91 in the direction indicated by arrow K and is moved and lifted according to the rotation of the separation member 92. In this way, the developing roller 6 is separated from the photosensitive drum 4.

In this case, the attitude regulation bosses 85 (85*a*, 85*b*, and 85*c*) of the memory tag unit 80 are not in contact with the attitude regulation holes 86 (86*a*, 86*b*, and 86*c*) of the developing cartridge 8, the position of the memory tag unit 80 is in the state of FIG. 10C, and the memory tag unit 80 is positioned with respect to the cartridge guide portion 33 and has a clearance with respect to the developing cartridge 8. Therefore, there is no influence on contact of the electrical contact portion of the memory tag 81 and the tray-side memory contact 32. Therefore, electrical connection between the memory tag 81 of the developing cartridge 8 and the control unit 43 of the apparatus body 2 is maintained before and after the separation operation.

Drawing-Out and Insertion of Cartridge Tray from and into Apparatus Body

Next, an operation of drawing the cartridge tray 3 out from the apparatus body 2 will be described with reference to FIGS. 1, 3A to 3C, and 12A to 12D. FIGS. 12A to 12D are cross-sectional schematic views of the image forming apparatus 1 illustrating the behavior when drawing the cartridge tray 3 out from the apparatus body 2 and illustrates a transition of the state of the cartridge tray 3 and the apparatus body 2 when seen from the right side surface of the image forming apparatus 1.

As illustrated in FIG. 1, a tray guide 49 is formed on both side surfaces of the tray frame 30 so as to protrude toward the outer side of the tray frame 30 from the side surfaces. A guide roller 50 that is supported so as to be rotatable with respect to the tray frame 30 is provided on a side of the tray guide 49 close to the rear surface of the image forming apparatus. The tray guide 49 as a tray guide portion is provided along a moving direction in which the cartridge tray 3 is inserted and drawn out.

Figure 12A:
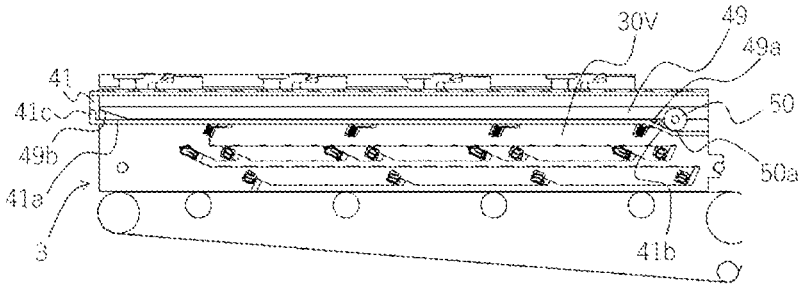
FIGS. 12A to 12D are state transition diagrams during drawing-out and insertion of the cartridge tray according to Embodiment 1.

As illustrated in FIG. 12A, a tray position at which the cartridge tray 3 is housed in the apparatus body 2 is referred to as a first position. The first position is a housed position at which the cartridge tray 3 is housed in a housing portion. At the first position, a lowermost portion 50*a* of the guide roller 50 is under a tray guide lower surface 49*a* in the second direction. A tray guide inclined surface 49*b* is formed in an end of the tray guide 49 close to the front surface of the image forming apparatus. In this example, the tray guide inclined surface 49*b* is inclined upward in the second direction as it approaches a front-side end of the tray guide 49.

As illustrated in FIGS. 3B and 3C, a rail 41 is provided on both surfaces of the housing portion of the cartridge tray 3 of the apparatus body 2. The rail 41 as a rail portion is provided along the moving direction in which the cartridge tray 3 is inserted or drawn out similarly to the tray guide 49. The rail 41 movably supports the cartridge tray 3 in cooperation with the tray guide 49. A rail lower surface 41*a* facing the cartridge tray 3 in the second direction is provided on a lower side of the rail 41. A rail inclined surface 41*b* inclined downward in the second direction as it approaches a rear-side end is provided on a side of the rail lower surface 41*a* close to the rear surface of the image forming apparatus. A tray stopper 41*c* protruding upward in the second direction from the rail lower surface 41*a* is formed on an end of the rail 41 close to the front surface of the image forming apparatus.

Figure 12B:
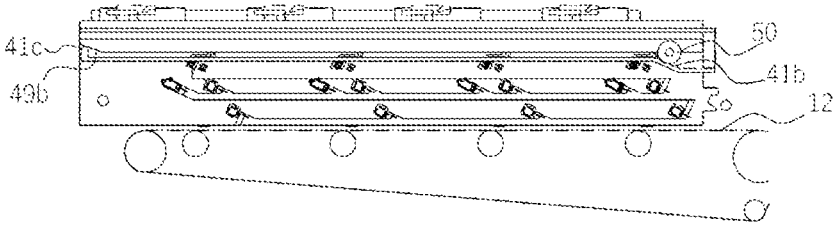

During replacement of the developing cartridge 8, a user opens the front door 40 of the image forming apparatus and draws the cartridge tray 3 housed in the apparatus body 2 from the first position toward the front surface side. At that time, as illustrated in FIG. 12B, the tray guide inclined surface 49*b* and the tray stopper 41*c* make contact with each other and the guide roller 50 and the rail inclined surface 41*b* make contact with each other, whereby the cartridge tray 3 moves toward the upper side in the second direction with respect to the apparatus body 2 as it is drawn out toward the front surface side. In this way, the photosensitive drum 4 and the transfer belt 12 are separated from each other, and the cartridge tray 3 can be drawn out without damaging the surface of the photosensitive drum 4.

Figure 12C:
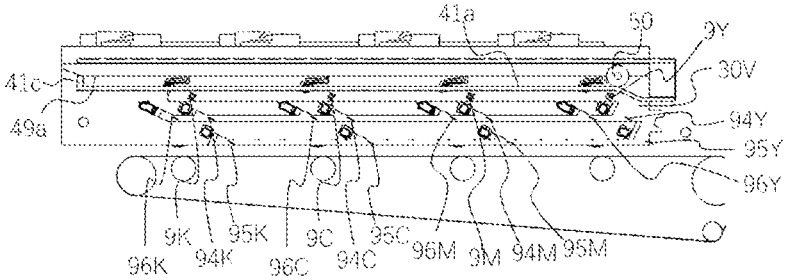

The position of the cartridge tray 3 when the user draws out the cartridge tray 3 further and the cartridge tray 3 is lifted upward in the second direction as illustrated in FIG. 12C is referred to as a second position. When the cartridge tray 3 is at the second position or a position drawn out toward the front surface side further than the second position, the tray guide lower surface 49*a* and the tray stopper 41*c* are in contact with each other and the guide roller 50 and the rail lower surface 41*a* are in contact with each other. That is, in a drawing-out operation after the cartridge tray 3 is lifted to the second position, the height in the second direction of the cartridge tray 3 is maintained. The cartridge tray 3 is drawn out toward the front surface side of the apparatus body 2 while maintaining the same height.

Figure 12D:
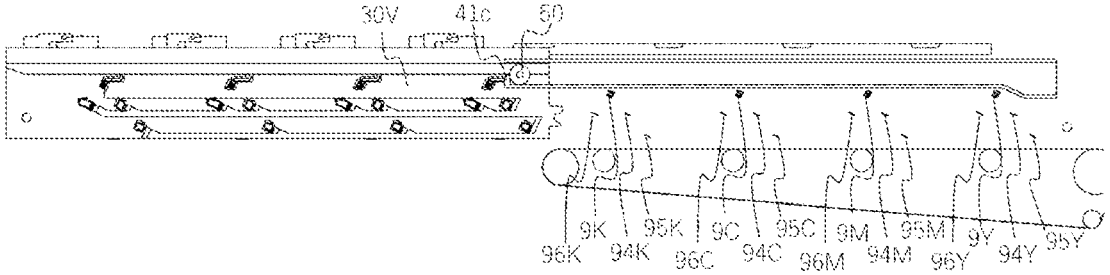

When the cartridge tray 3 is drawn out further, as illustrated in FIG. 12D, the guide roller 50 stops by abutting on the tray stopper 41*c*. The position of the cartridge tray 3 at that time is referred to as a third position. At the third position, since the upper side which is the drawing-out direction of the developing cartridge 8 is open, the user can easily replace the developing cartridge 8. Since the second and third positions are positions at which the cartridge tray is drawn out from the housing portion of the apparatus body, the positions are referred to as a drawn-out position.

When the cartridge tray 3 is inserted into the apparatus body 2 from the third position, the cartridge tray 3 reaches the second position while maintaining the height in the second direction the same as the third position in a reverse order from that during drawing-out. The cartridge tray 3 moves up to the first position from the second position while lowering the height in the second direction. In this case, since the photosensitive drum 4 and the transfer belt 12 are separated from each other until the cartridge tray 3 reaches the first position, it is possible to complete insertion of the cartridge tray 3 without damaging the surface of the photosensitive drum 4.

Configuration of Contact Portion Between Apparatus Body and Cartridge Tray

Figure 13A:
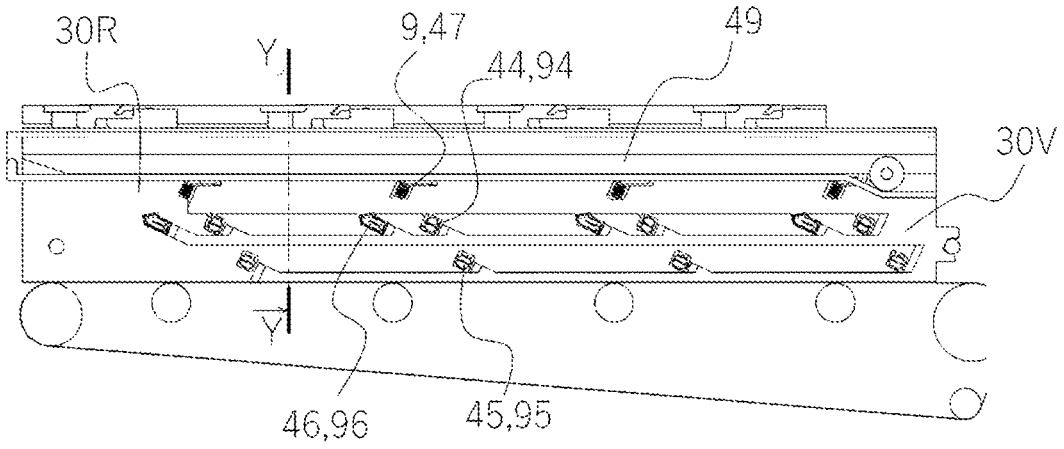
FIGS. 13A and 13B are state transition diagrams during drawing-out and insertion of the cartridge tray according to Embodiment 1.

Next, a configuration of a contact portion between the apparatus body 2 and the cartridge tray 3 will be described with reference to FIGS. 1, 12A to 12D, and 13A to 15. FIGS. 13 and 14 are cross-sectional schematic views of the image forming apparatus 1 illustrating the behavior when the cartridge tray 3 is drawn out from the apparatus body 2 and illustrate the transition of the state of the cartridge tray 3 and the apparatus body 2 when seen from the front surface side of the image forming apparatus 1. FIG. 15 is a right side view of the cartridge tray 3.

As illustrated in FIG. 1, the tray-side charging contacts 44 (44Y, 44M, 44C, and 44K), the tray-side cleaner contacts 45 (45Y, 45M, 45C, and 45K), the tray-side developing contacts 46 (46Y, 46M, 46C, and 46K), and the tray-side metal terminals 47 (47Y, 47M, 47C, and 47K) are provided on the tray right side surface 30R so as to correspond to the charging roller 5, the cleaning roller 7, the developing cartridge 8, and the memory tag 81, respectively. In this example, the tray-side charging contact 44, the tray-side cleaner contact 45, the tray-side developing contact 46, and the tray-side metal terminal 47 are disposed in a region on the lower side of the separation member 93 and the tray guide 49 in the second direction.

A contact avoiding surface 30V positioned on the left side (the inner side of the image forming apparatus 1) in the first direction with respect to each of the tray-side charging contact 44, the tray-side developing contact 46, the tray-side cleaner contact 45, and the tray-side metal terminal 47 is provided on the tray right side surface 30R. The contact avoiding surface 30V includes a region extending toward the lower side in the second direction and the rear surface side in the third direction with respect to each of the tray-side charging contact 44, the tray-side cleaner contact 45, the tray-side developing contact 46, and the tray-side metal terminal 47. The contact avoiding surface 30V is a region recessed one step lower than the other region of the tray right side surface 30R.

As illustrated in FIG. 3C, the charging contact 94, the cleaner contact 95, the developing contact 96, and the body-side metal terminal 9 are provided in a body right side wall 2R which is a surface facing the tray right side surface 30R, of the housing portion of the apparatus body 2 housing the cartridge tray 3 so as to correspond to the tray-side charging contact 44, the tray-side cleaner contact 45, the tray-side developing contact 46, and the tray-side metal terminal 47. The charging contact 94, the cleaner contact 95, the developing contact 96, and the body-side metal terminal 9 are metallic members and have a spring property in the first direction.

Figure 13B:
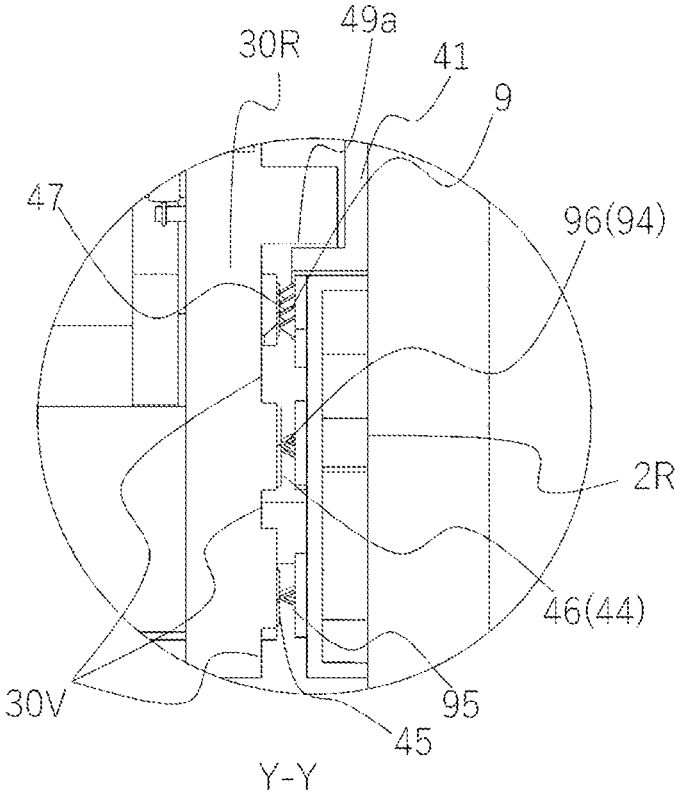

FIG. 13A is a side view when the cartridge tray 3 at the first position is seen toward the first direction and displays and projects the apparatus body-side contacts in a superimposed manner. FIG. 13B is a cross-sectional view along Y-Y in FIG. 13A. As illustrated in FIGS. 13A and 13B, when the cartridge tray 3 is at the first position, the charging contact 94, the cleaner contact 95, the developing contact 96, and the body-side metal terminal 9 make contact with the tray-side charging contact 44, the tray-side cleaner contact 45, the tray-side developing contact 46, and the tray-side metal terminal 47 with prescribed contact pressure, respectively. In the present embodiment, the charging contact 94, the developing contact 96, the tray-side charging contact 44, and the tray-side developing contact 46 are disposed substantially at the same height in the second direction. Therefore, in FIG. 13B, the charging contact 94 and the developing contact 96 and the tray-side charging contact 44 and the tray-side developing contact 46 are illustrated in a superimposed manner.

Figure 14A:
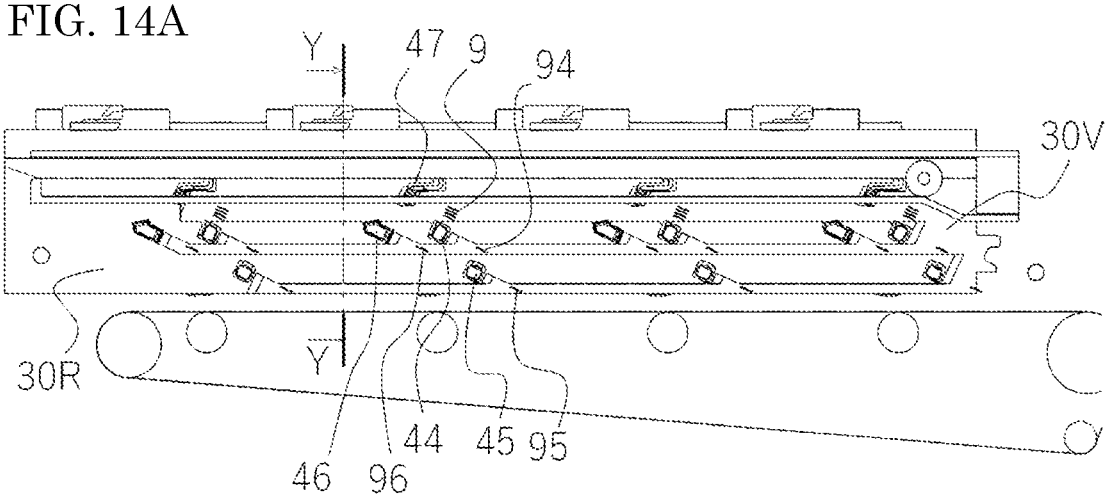
FIGS. 14A and 14B are state transition diagrams during drawing-out and insertion of the cartridge tray according to Embodiment 1.
Figure 14B:
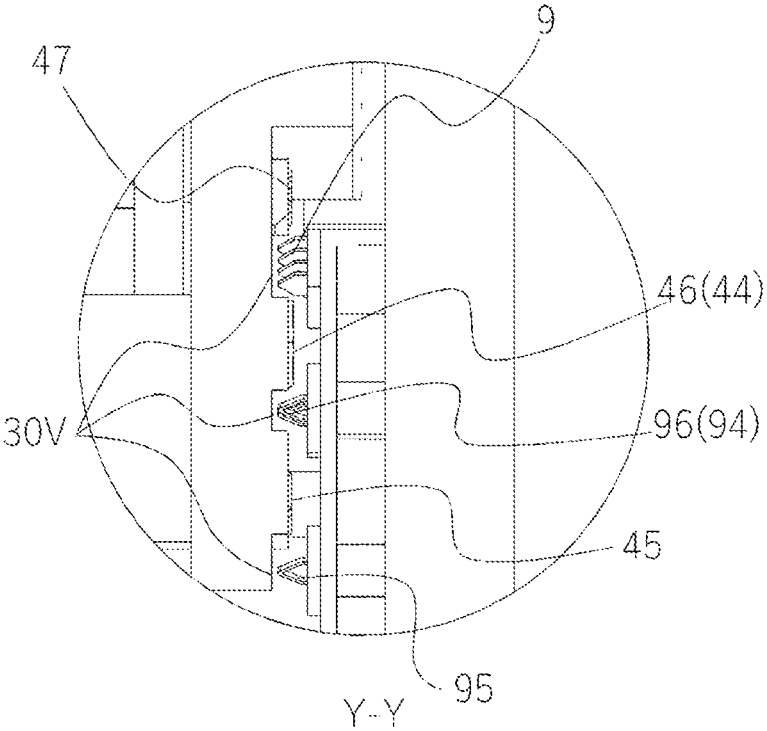
Figure 15:
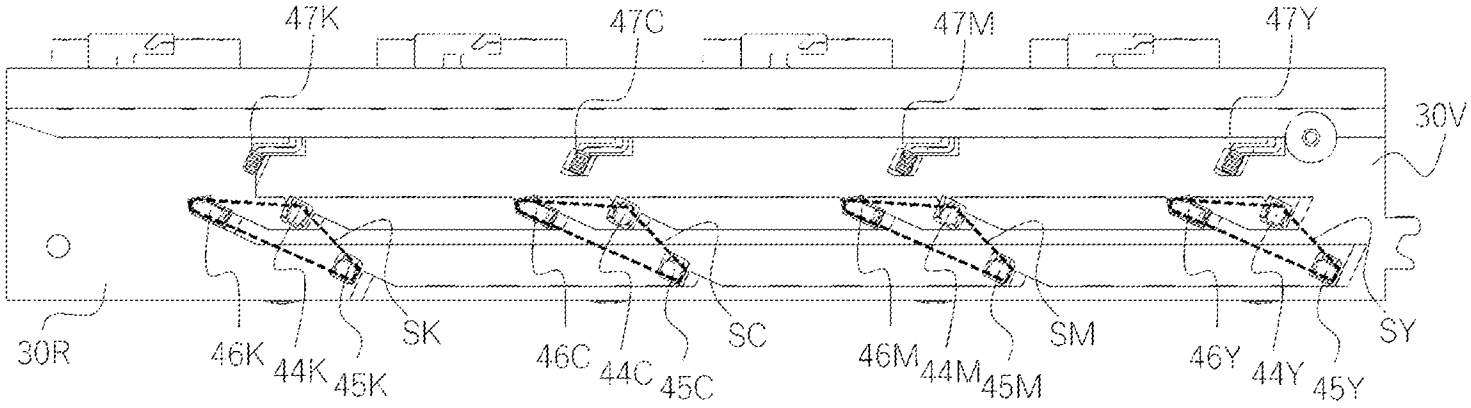
FIG. 15 is a side view of a non-driving side of the cartridge tray according to Embodiment 1.

FIGS. 14A and 14B illustrate a state in which the cartridge tray 3 moves from the first position to the second position and the cartridge tray 3 is moved upward in the second direction. FIG. 14A is a view when the cartridge tray 3 is seen from the first direction and FIG. 14B is a cross-sectional view along Y-Y. In FIGS. 14A and 14B, the contact avoiding surface 30V faces the charging contact 94, the cleaner contact 95, the developing contact 96, and the body-side metal terminal 9 in the first direction.

At the first position illustrated in FIGS. 13A and 13B, the charging contact 94, the cleaner contact 95, the developing contact 96, and the body-side metal terminal 9 are in contact with the cartridge tray 3 with prescribed contact pressure. On the other hand, at the second position illustrated in FIGS. 14A and 14B, the charging contact 94, the cleaner contact 95, the developing contact 96, and the body-side metal terminal 9 protrude by being displaced toward the inner side in the first direction. That is, in the present embodiment, the charging contact 94, the cleaner contact 95, the developing contact 96, and the body-side metal terminal 9 are in a free state in which they are not elastically deformed in the first direction. In this case, since the contact avoiding surface 30V is recessed one step lower when seen from the apparatus body side, the contact avoiding surface 30V and the charging contact 94, the cleaner contact 95, the developing contact 96, and the body-side metal terminal 9 in the protruding state are not in contact with each other in the first direction.

As illustrated in FIG. 12C corresponding to the second position, the contact avoiding surface 30V has a region extending toward the rear surface side in the third direction from the position facing the charging contact 94, the cleaner contact 95, the developing contact 96, and the body-side metal terminal 9 in the first direction. Therefore, when the cartridge tray 3 moves from the second position to the third position, the charging contact 94, the cleaner contact 95, the developing contact 96, and the body-side metal terminal 9 will not make contact with the cartridge tray 3.

Due to the above-described configuration, when the cartridge tray 3 is drawn out from the apparatus body 2, it is possible to prevent the charging contact 94, the cleaner contact 95, the developing contact 96, and the body-side metal terminal 9 of the apparatus body 2 from making contact with a portion of the cartridge tray 3 and being deformed or damaged.

Further Advantageous Configuration of Cartridge Tray

Positional Relationship between Tray-side Metal Terminal and Other Terminals

In the present embodiment, as illustrated in FIG. 15, the tray-side metal terminal 47 is disposed on the outer side of regions S (SY, SM, SC, and SK) surrounded by the tray-side charging contact 44, the tray-side cleaner contact 45, and the tray-side developing contact 46 when seen from the projection surface in the first direction of the tray right side surface 30R.

A voltage having a potential difference of approximately several hundreds to 1000 volts is applied from the ground to the tray-side charging contact 44, the tray-side cleaner contact 45, and the tray-side developing contact 46 which are contact portions used for printing. On the other hand, communication between the apparatus body 2 and the memory tag 81 via the tray-side metal terminal 47 is performed using a voltage (for example, 3.3 volts, 12 volts, or the like) lower than the voltage of the contact portions used for printing. That is, the potential difference between the tray-side metal terminal 47 and the contact portions used for printing is large. Therefore, when the tray-side metal terminal 47 is disposed near the contact portions used for printing, damage of the memory tag 81 due to leakage of electricity or communication failure due to electromagnetic noise may occur. In the present embodiment, since the tray-side metal terminal 47 is disposed away from the vicinity of the contact portions used for printing, it is possible to prevent damage of the memory tag 81 due to leakage of electricity or communication failure due to electromagnetic noise.

As described above, the tray-side cleaner contact 45 may not be provided as in the case where the cleaning unit is not provided and the case where a rubber blade or a sheet is used as the cleaning unit. In these cases, it is desirable to create a positional relationship in which the adverse effect on the tray-side metal terminal 47 of the leakage of electricity or electromagnetic noise from the tray-side charging contact 44 and the tray-side developing contact 46 is prevented. In order to realize such a positional relationship, for example, the tray-side metal terminal 47 may be disposed in regions other than the region between the tray-side charging contact 44 and the tray-side developing contact 46. Both the distance between the tray-side metal terminal 47 and the tray-side charging contact 44 and the distance between the tray-side metal terminal 47 and the tray-side developing contact 46 may be longer than the distance between the tray-side charging contact 44 and the tray-side developing contact 46.

In the present embodiment, the tray-side metal terminal 47 is provided in a region different from the contact portions used for printing in the second direction when seen from the third direction. However, the present invention is not limited to this configuration. That is, the tray-side metal terminal 47 may be provided in a region overlapping some of the contact portions used for printing in the second direction when seen from the third direction.

Figure 16:
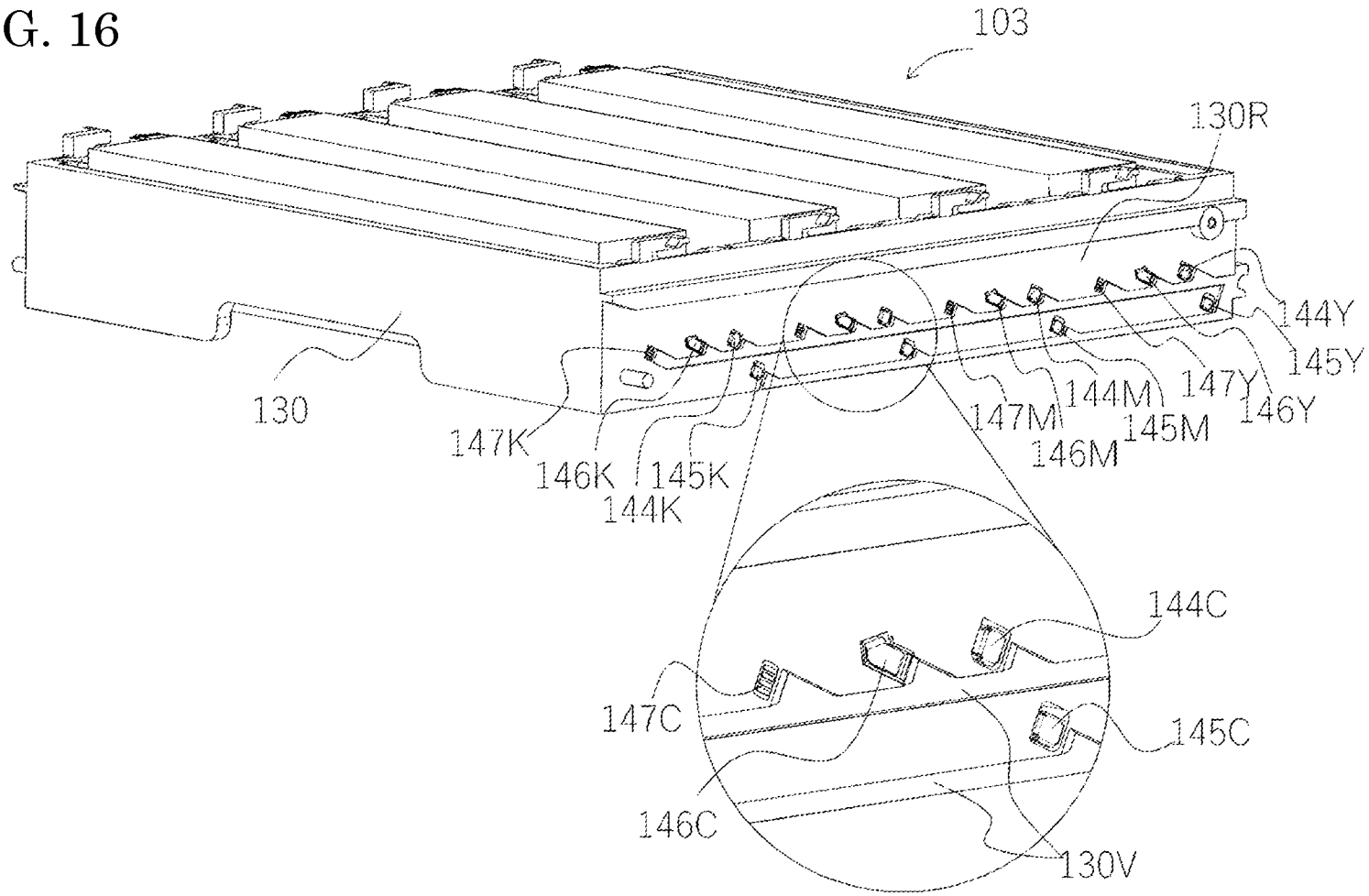
FIG. 16 is a perspective view of a cartridge tray according to another example of Embodiment 1.

For example, in FIG. 16, a tray-side metal terminal 147 is provided in a region overlapping a tray-side charging contact 144 and a tray-side developing contact 146 in the second direction when seen from the third direction. Due to this, when a tray right side surface 130R is seen from the first direction, a region of a contact avoiding surface 130V facing the charging contact 94 and the developing contact 96 when a cartridge tray 103 is drawn out from the apparatus body 2 can be shared with a region facing the body-side metal terminal 9.

In this case, when the region of the contact avoiding surface 130V of the tray right side surface 130R widens, since the thickness in the first direction of the tray right side surface 130R decreases, the strength of the tray frame 130 decreases. However, as in FIG. 16, the tray-side metal terminal 147 and at least one of the contact portions used for printing may be provided in an overlapping region in the second direction whereby the region of the contact avoiding surface 130V can be narrowed. Therefore, it is possible to provide the tray-side metal terminal 147 without sacrificing the strength of the tray frame 130.

In FIG. 16, the tray-side metal terminal 147 is disposed at a position sufficiently separated from the tray-side charging contact 144, the tray-side cleaner contact 145, and the tray-side developing contact 146 when seen from the first direction. In this way, it is possible to reduce the influence on the tray-side metal terminal 147, of electromagnetic noise of the contact portions used for printing.

In FIG. 16, the tray-side metal terminal 147 is provided in a region overlapping the tray-side charging contact 144 and the tray-side developing contact 146 in the second direction. However, even when the tray-side metal terminal 147 is provided in a region overlapping the tray-side cleaner contact 145 in the second direction, it is possible to obtain the effect of preventing the contact avoiding surface from widening. That is, it is sufficient that the heights in the second direction of the tray-side metal terminal 147 and at least one of the other contacts are aligned.

Positional Relationship between Tray-side Metal Terminal and Separation Member

In the present invention, the tray-side metal terminal 47 is disposed on the lower side of the separation member 93 in the second direction. The lower side mentioned herein refers to the lower side in the second direction when the apparatus is installed in the same manner as during printing.

Here, details of a separation operation will be described. As illustrated in FIG. 3C, the separation and pressing member 60 which is a movable mechanism is disposed in the body right side wall 2R on the outer side of the separation member 93. The separation and pressing member 60 has a configuration in which separating and pressing pieces 60K, 60C, 60M, and 60Y are provided in a planar backup member extending in the third direction (here, 60Y is hidden in a frame). During the separation operation, the entire separation and pressing member 60 moves toward the inner side of the apparatus which is the third direction (toward the left side of the sheet surface).

A separation member 93C illustrated in FIG. 11B will be described as a representative example of the separation members 93 (93K, 93C, 93M, and 93Y). The separation member 93C has a separation member protruding portion 93Ca1 protruding toward the body right side wall 2R, and an inclined portion 93Ca2 inclined toward the front door 40 of the apparatus is provided in the separation member protruding portion 93Ca1.

When the entire separation and pressing member 60 moves toward the inner side of the apparatus in the third direction, the separating and pressing piece 60C makes contact with the inclined portion 93Ca2. When the separation and pressing member 60 is pushed further deeply, the separation member 93C rotates about the separation rotation center and the developing roller 6C is separated from the photosensitive drum 4C. At the same time, a similar separation operation is performed with respect to the separation members 93K, 93M, and 93Y.

In this configuration, when the tray-side metal terminal 47 is provided at the same height as the separation member 93, the body-side metal terminal 9 facing the tray-side metal terminal 47 and the separation and pressing member 60 facing the separation member 93 also need to be provided at the same height. However, in this configuration, the separation and pressing member 60 may rub against the body-side metal terminal 9 when the separation and pressing member 60 moves in the third direction. An operation for arranging the body-side metal terminal 9 may be formed in the separation and pressing member 60, for example, in order to prevent occurrence of rubbing. However, in this case, the strength of the separation and pressing member 60 may decrease.

Therefore, in the present invention, as described above, the tray-side metal terminal 47 is disposed on the lower side of the separation member 93 in the second direction. Due to this, the body-side metal terminal 9 can be provided at such a position that the entire separation and pressing member 60 does not rub against the body-side metal terminal 9 even when it moves in the third direction. Therefore, it is possible to mount a configuration for electrically connecting the apparatus body 2 and the memory tag 81 of the developing cartridge 8 without decreasing the strength of the separation and pressing member 60.

As illustrated in FIGS. 1 and 11B, the separation member 93 has a certain height in the second direction. In order to meet the positional relationship that "the tray-side metal terminal 47 is on the lower side of the separation member 93" mentioned herein, as illustrated in FIG. 1, it is preferable to meet such a relationship that at least the upper end of the tray-side metal terminal 47 in the second direction comes further downward than the lower end of a region of the separation member 93 exposed to the tray right side surface 30R. In this way, since the heights of the separation and pressing member 60 and the body-side metal terminal 9 in the second direction can be shifted, it is possible to prevent occurrence of rubbing.

Positional Relationship Between Tray-Side Metal Terminal and Tray Guide

In the present invention, the tray-side metal terminal 47 is disposed on the lower side of the tray guide 49 in the second direction. The lower side mentioned herein refers to the lower side in the second direction when the apparatus is installed in the same manner as during printing.

The tray guide 49 engages with the rail 41 of the apparatus body 2 and rubs against the rail 41 when the cartridge tray 3 is drawn out and inserted. Therefore, when the tray-side metal terminal 47 is provided at the same height as the tray guide 49, the tray-side metal terminal 47 and the corresponding body-side metal terminal 9 may be worn or damaged due to rubbing against the rail 41. However, according to the present invention, since the tray-side metal terminal 47 and the body-side metal terminal 9 can be provided while avoiding the rubbing portion between the tray guide 49 and the rail 41, it is possible to prevent wear and damage of the tray-side metal terminal 47 and the body-side metal terminal 9.

In the present embodiment, the position at which the tray guide 49 is provided in the tray right side surface 30R and the tray left side surface 30L of the cartridge tray 3 is a relatively high position in the second direction. Therefore, the tray-side metal terminal 47 is disposed on the lower side of the tray guide 49 so that the heights are shifted from each other. However, when the tray guide 49 is provided at a low position in the second direction, even when the tray-side metal terminal 47 is disposed on the upper side of the tray guide 49, the heights of both can be shifted from each other.

According to the present embodiment, since the tray-side metal terminal 47 is disposed on the tray right side surface 30R and the body-side metal terminal 9 is disposed so as to face the tray-side metal terminal 47, the body-side metal terminal 9 and the power supply circuit board disposed inside the right side wall 2R so as to follow the right side wall 2R can be connected in a short distance. For example, when the tray-side metal terminal 47 is disposed in the tray rear surface 30B and the body-side metal terminal 9 is disposed so as to face the tray-side metal terminal 47, although wirings need to be routed up to the power supply circuit board, it is not necessarily so in the present embodiment. An effect of suppressing increase in the apparatus size is obtained as compared to a case in which new connectors are provided on the cartridge tray and the apparatus body in order to realize electrical connection.

In an image forming apparatus in which a developing cartridge having a memory medium recording a residual developer amount and the like mounted therein is detachably attached to a cartridge tray, it is possible to stabilize communication between the memory medium and the apparatus body. In this case, wear or the like of the cartridge tray and the apparatus body will not occur and the strength of respective members of the image forming apparatus will not be sacrificed.

Embodiment 2

Figure 17:
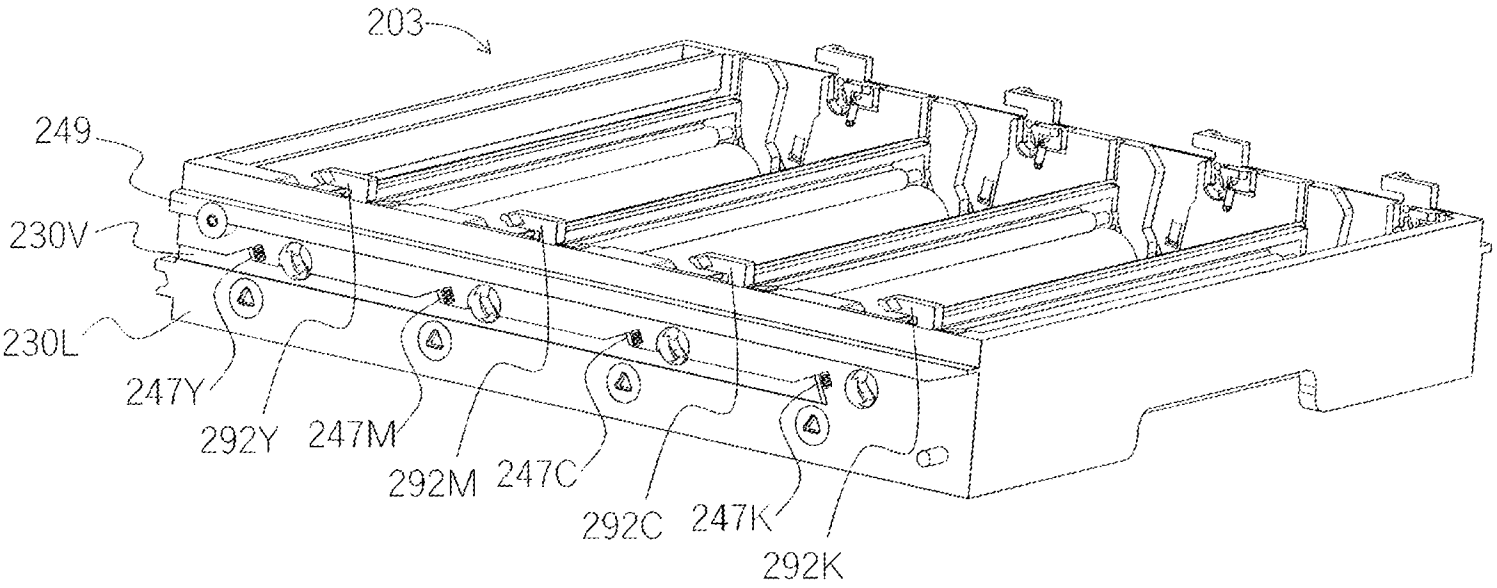
FIG. 17 is a perspective view of a cartridge tray according to Embodiment 2.
Figure 18:
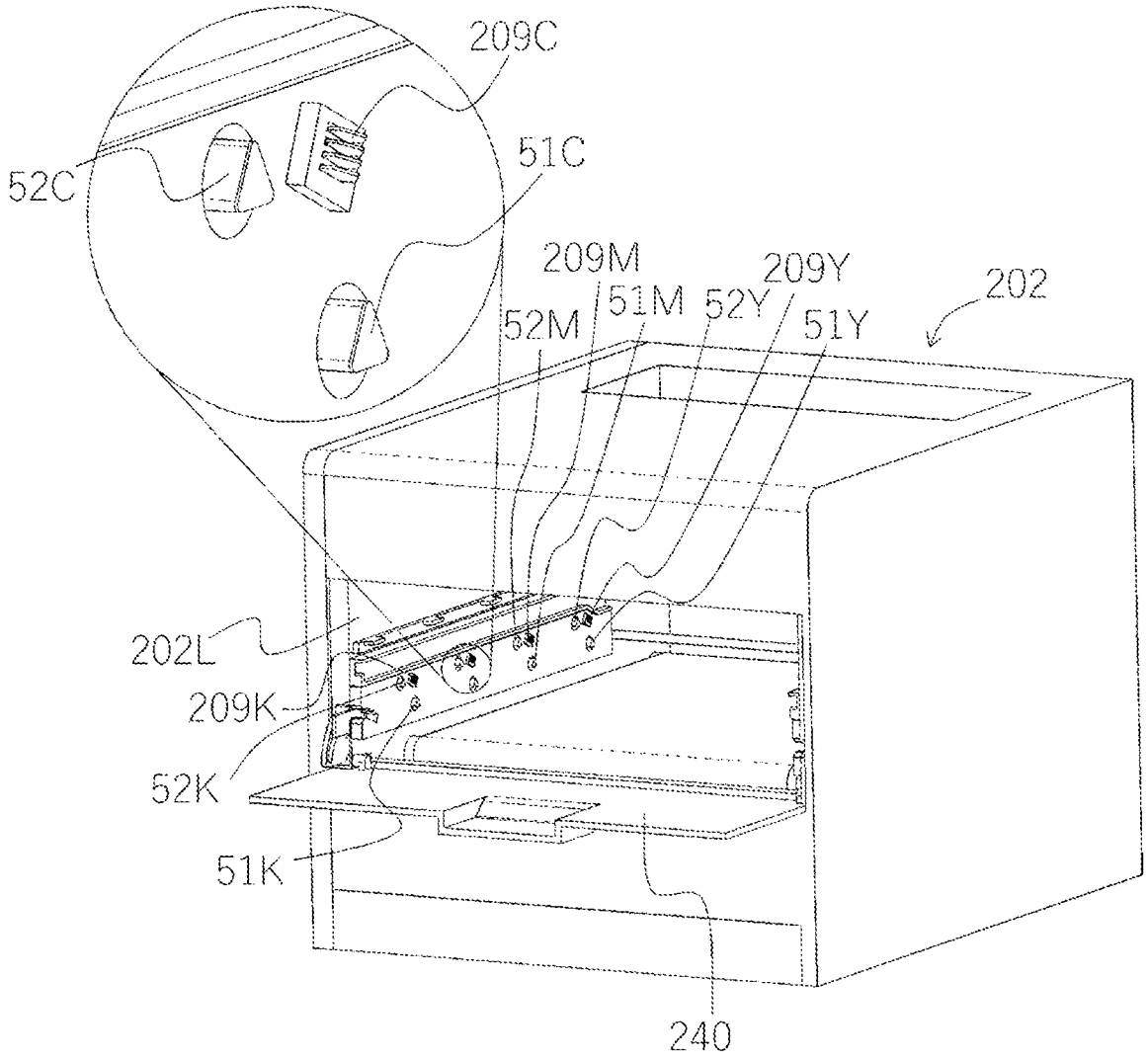
FIG. 18 is a perspective view of an image forming apparatus according to Embodiment 2.

Next, Embodiment 2 will be described. Description of the same portions as those of the configuration of Embodiment 1 will be omitted, and portions different from those of Embodiment 1 will be described with reference to FIGS. 17 and 18. FIG. 17 is a perspective view of a cartridge tray 203 according to Embodiment 2. FIG. 18 is a perspective view of an apparatus body 202 according to Embodiment 2.

As illustrated in FIG. 17, in the present embodiment, tray-side metal terminals 247 (247Y, 247M, 247C, and 247K) are provided on a tray left side surface 230L which is the left side surface of the cartridge tray 203. The tray-side metal terminal 247 is disposed in a region on the lower side of separation members 292 (292Y, 292M, 292C, and 292K) and a tray guide 249 in the second direction.

A contact avoiding surface 230V positioned on the right side (the inner side of the image forming apparatus 201) in the first direction with respect to the tray-side metal terminal 247 is provided on the tray left side surface 230L. The contact avoiding surface 230V includes a region extending toward the lower side in the second direction and the rear surface side in the third direction with respect to the tray-side metal terminal 247. The contact avoiding surface 230V is provided in the left side surface 230L of the cartridge tray 203 so as to be recessed one step lower toward a deeper side in the first direction when seen from the apparatus body 202 facing the contact avoiding surface 230V.

As illustrated in FIG. 18, body-side metal terminals 209 (209Y, 209M, 209C, and 209K) are provided on a body left side wall 202L which is a surface facing the tray left side surface 230L, of a housing portion of the apparatus body 202 housing the cartridge tray 203 so as to correspond to the tray-side metal terminals 247. The body-side metal terminal 209 is a metallic member and has a spring property in the first direction. That is, in the present embodiment, the tray-side metal terminal 247 and the contact portions used for printing are disposed on different side surfaces rather than the same surface. Similarly to Embodiment 1, a circuit board in which one or plural motors for driving the developing driving coupling 51 and the drum driving coupling 52 and the driver circuits thereof are provided is disposed inside the left side wall 202L so as to follow the left side wall 202L. That is, the left side wall 202L has such a thickness that the left side wall 202L has a space in which the power supply device can be disposed similarly to Embodiment 1.

Figure 19A:
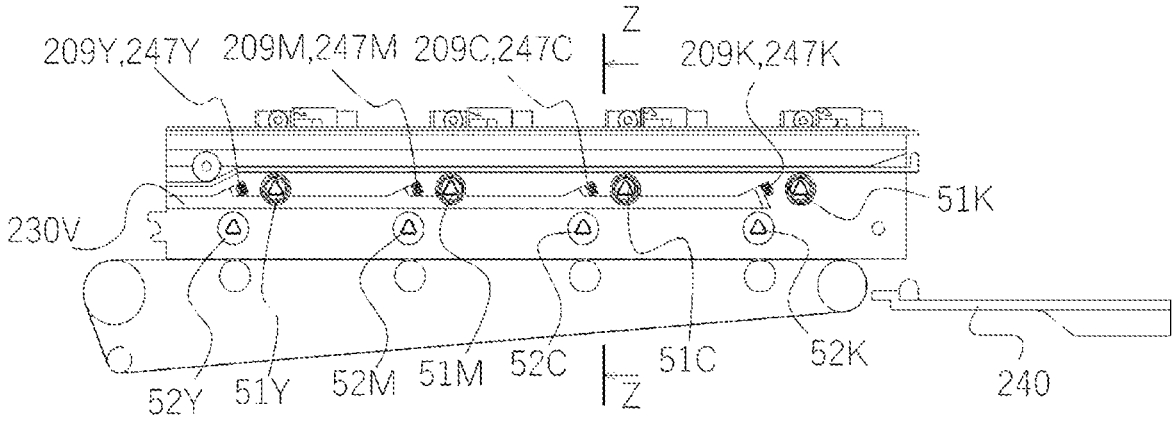
FIGS. 19A and 19B are state diagrams during drawing-out and insertion of the cartridge tray according to Embodiment 2.
Figure 19B:
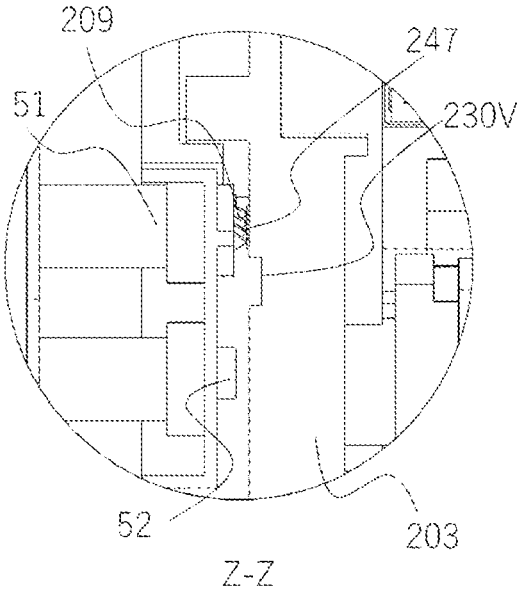

FIG. 19A is a cross-sectional view when the cartridge tray 203 is at the first position at which the cartridge tray 203 is housed in the apparatus body 202 and FIG. 19B is a cross-sectional view along Z-Z. In this case, the body-side metal terminal 209 is in contact with the tray-side metal terminal 247 with prescribed contact pressure. When the cartridge tray 203 is to be drawn out from the apparatus body 202, first, the front door 240 of the image forming apparatus 201 is open. In this case, in conjunction with the operation of opening the front door 240, the developing driving coupling 51 and the drum driving coupling 52 are moved toward the left side (the outer side of the image forming apparatus) in the first direction and be positioned at a position at which the couplings do not make contact with the cartridge tray 203.

Figure 20A:
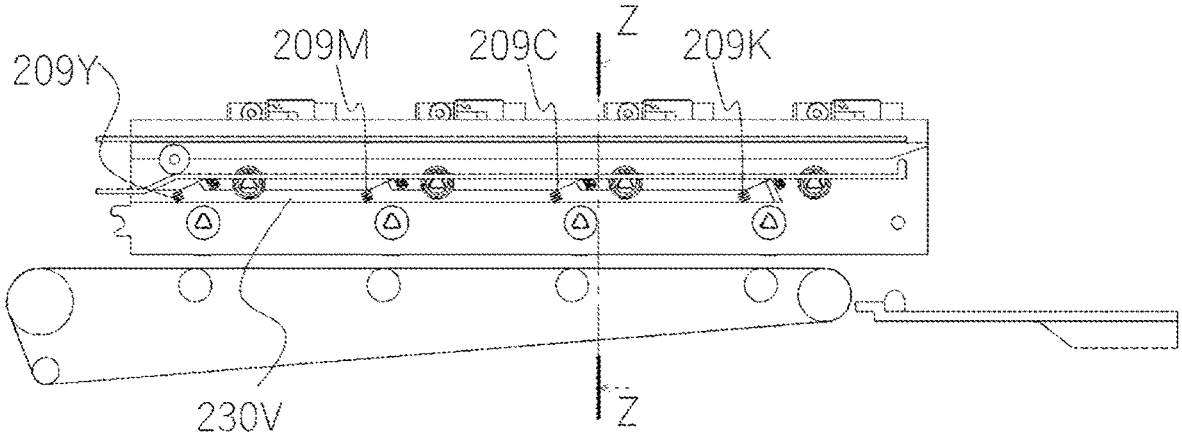
FIGS. 20A and 20B are state transition diagrams during drawing-out and insertion of the cartridge tray according to Embodiment 2.
Figure 20B:
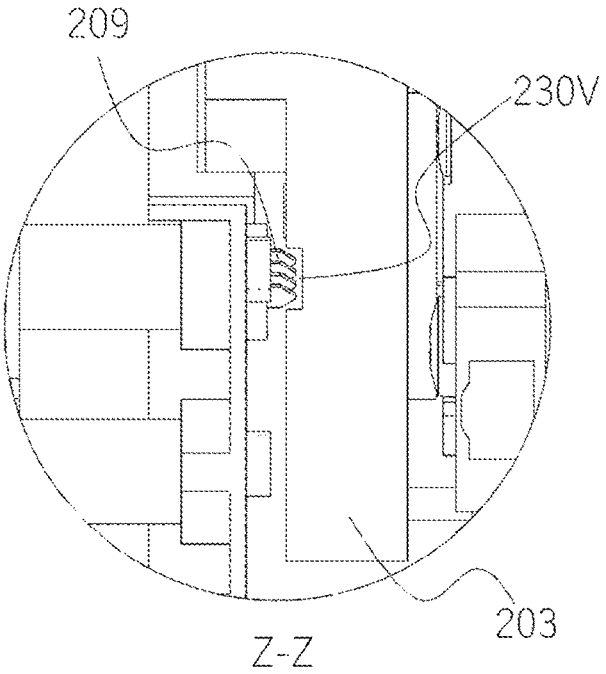

FIG. 20A is a cross-sectional view when the cartridge tray 203 is drawn out from the apparatus body 202 and is moved to the second position, and FIG. 20B is a cross-sectional view along Z-Z. During movement from the first position to the second position, the cartridge tray 203 moves upward in the second direction whereby the contact avoiding surface 230V faces the body-side metal terminal 209 in the first direction. In this case, the body-side metal terminal 209 is displaced toward the inner side in the first direction from the position at which the body-side metal terminal 209 makes contact with the cartridge tray 203 with prescribed contact pressure at the first position. That is, in the present embodiment, similarly to Embodiment 1, the body-side metal terminal 209 is in a free state in which the terminal is not elastically deformed in the first direction. In this case, since the contact avoiding surface 230V is present, the contact avoiding surface 230V and the body-side metal terminal 209 do not make contact with each other in the first direction.

The contact avoiding surface 230V has a region extending toward the rear surface side in the third direction from the position at which the surface faces the body-side metal terminal 209 in the first direction. Therefore, when the cartridge tray 203 moves from the second position to the third position, the body-side metal terminal 209 does not make contact with the cartridge tray 203.

In the present embodiment, similarly to Embodiment 1, an effect of preventing deformation and damage of members in the process of drawing out the cartridge tray 203 is obtained. Furthermore, in the present embodiment, since the tray-side metal terminal 247 is disposed on the driving side opposite to the contact portions used for printing, which use a high voltage, the effect of preventing damage of the memory medium due to leakage of electricity can be enhanced.

Similarly to Embodiment 1, the tray-side metal terminal 247 is disposed on the left side wall 202L and the body-side metal terminal 209 is disposed so as to face the tray-side metal terminal 247. Due to this, the body-side metal terminal 209 and the circuit board disposed inside the right side wall 202L so as to follow the left side wall 202L can be connected in a short distance. For example, when the tray-side metal terminal 47 is disposed in the tray rear surface 30B and the body-side metal terminal 209 is disposed so as to face the tray-side metal terminal 47, although wirings need to be routed up to the power supply circuit board, it is not necessarily so in the present embodiment. An effect of suppressing increase in the apparatus size is obtained as compared to a case in which new connectors are provided on the cartridge tray and the apparatus body in order to realize electrical connection.

Embodiment 3

Next, Embodiment 3 of the present invention will be described. Description of the same portions as those of the configuration of Embodiment 2 will be omitted, and portions different from those of Embodiment 2 will be described with reference to FIGS. 21, 22A and 22B.

Figure 21:
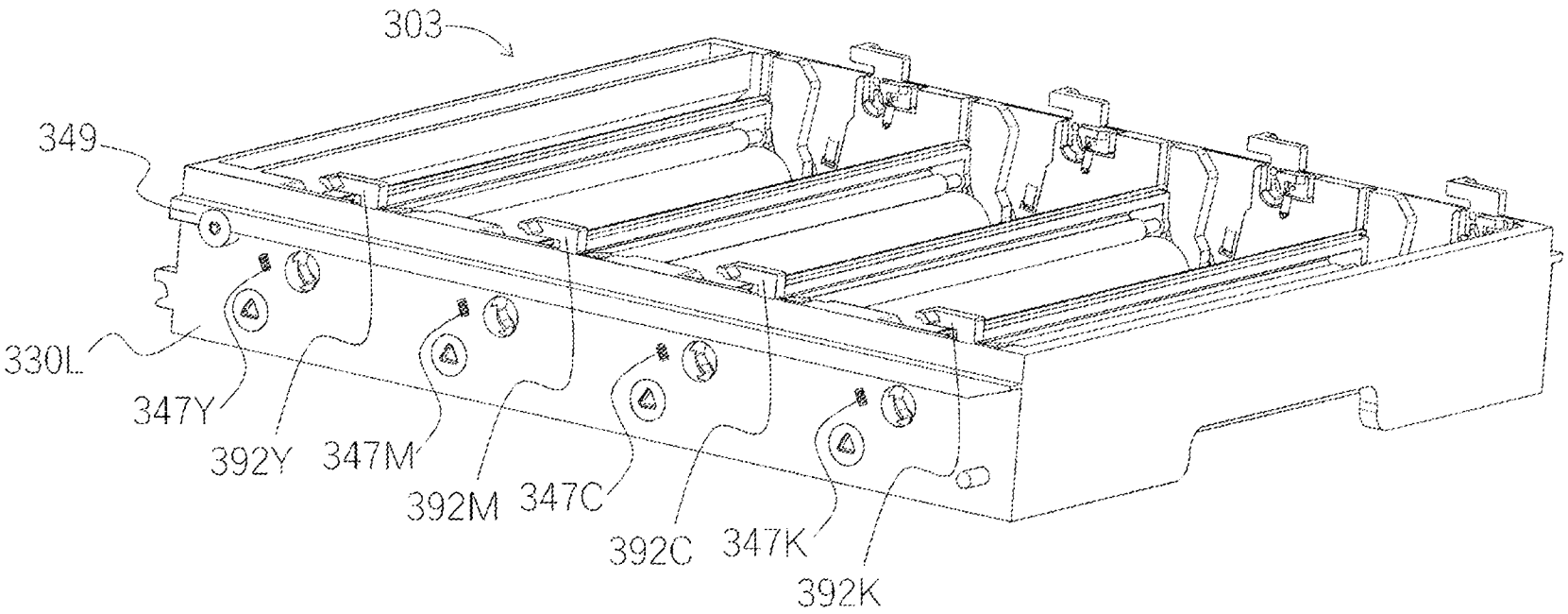
FIG. 21 is a perspective view of a cartridge tray according to Embodiment 3.

As illustrated in FIG. 21, in the present embodiment, similarly to Embodiment 2, a tray-side metal terminal 347 is provided on the left side surface 330L of the cartridge tray 303. In the present embodiment, the position in the second direction of the tray-side metal terminal 347 is on the lower side of separation members 392 (392Y, 392M, 392C, and 392K) and a tray guide 349.

Similarly to Embodiment 2 illustrated in FIG. 18, a body-side metal terminal 309 is provided on a left side surface 202L of the apparatus body 202 so as to correspond to the tray-side metal terminal 347. The body-side metal terminal 309 is a metallic member and has a spring property in the first direction.

Figure 22A:
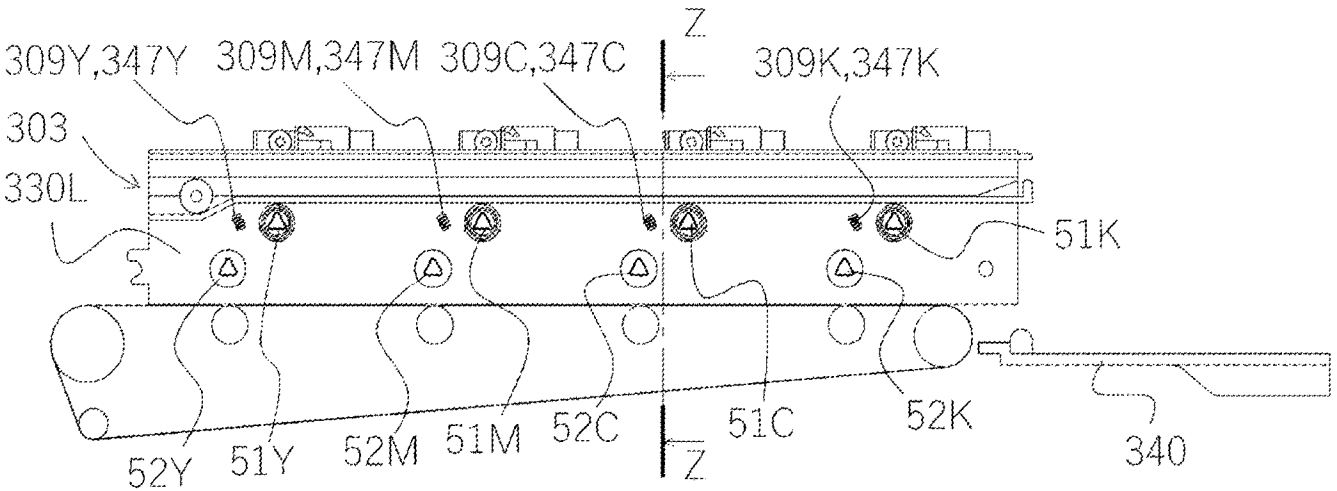
FIGS. 22A and 22B are state diagrams during drawing-out and insertion of the cartridge tray according to Embodiment 3.
Figure 22B:
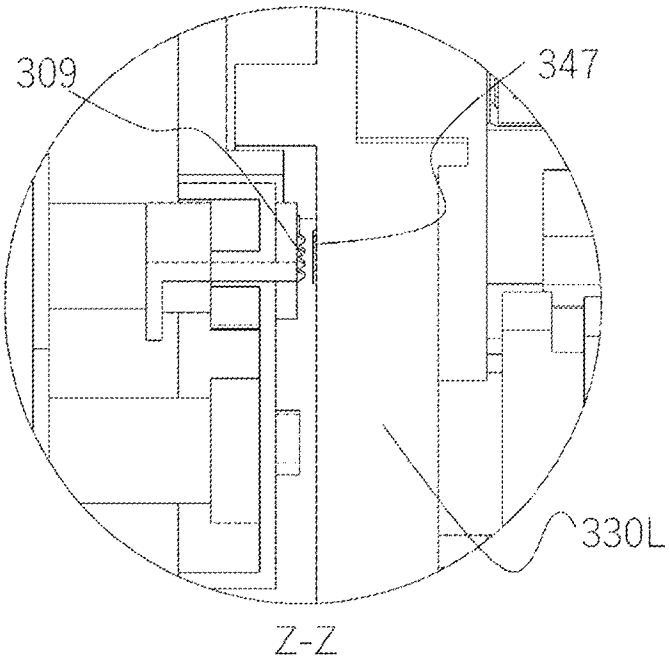

In the present embodiment, as illustrated in FIG. 22A, when a front door 340 of an image forming apparatus 301 is open, the body-side metal terminal 309 is moved toward the left side (the outer side of the image forming apparatus and a direction away from the cartridge tray 303) in the first direction in conjunction with the opening operation and is positioned at a position at which the terminal does not make contact with the cartridge tray 303 as illustrated in the view along Z-Z of FIG. 22B. In this case, the developing driving coupling 51 and the drum driving coupling 52 are also moved toward the left side (the outer side of the image forming apparatus) in the first direction simultaneously and are positioned at a position at which the couplings do not make contact with the cartridge tray 303.

As described above, in the present embodiment, in conjunction with an operation of opening the front door 340 as a door portion, an evacuation operation of evacuating the body-side metal terminal 309 and the like from the position at which the terminal rubs against the cartridge tray 303. By providing such an evacuation unit, the body-side metal terminal 309 does not make contact with the cartridge tray 303 when the cartridge tray 303 is drawn out from the apparatus body. Therefore, it is not necessary to provide the contact avoiding surface for avoiding the body-side metal terminal 309 in the tray left side surface 330L when the cartridge tray 303 is drawn out. That is, since it is not necessary to decrease the thickness in the first direction of the tray left side surface 330L, the strength of the tray left side surface 330L will not be sacrificed.

In the present embodiment, an effect similar to that of Embodiment 2 can be obtained. In the present embodiment, it is possible to stabilize communication between the memory medium and the apparatus body 302 without sacrificing the strength of the tray frame 330 and the cartridge tray 303 rubbing against the body-side metal terminal 309.

In the present embodiment, the tray-side metal terminal 347 and the tray-side electrical connectors (the tray-side charging contact, the tray-side cleaner contact, and the tray-side developing contact) are provided on different side surfaces of the cartridge tray 303. Therefore, the body-side metal terminal 309 and the body-side electrical connectors (the charging contact, the cleaner contact, and the developing contact) are provided on different side surfaces of the housing portion of the body. Therefore, such an evacuation unit that evacuates the body-side electrical connectors when the front door 340 is open may be provided in the body-side electrical connectors.

Similarly to Embodiment 1, when the tray-side metal terminal and the tray-side electrical connectors are disposed on the same side surface of the cartridge tray, an evacuation unit that evacuates the terminals when the front door 340 is open may be provided.

Other Embodiments

Embodiment(s) of the present invention can also be realized by a computer of a system or apparatus that reads out and executes computer executable instructions (e.g., one or more programs) recorded on a storage medium (which may also be referred to more fully as 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™, a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-139114, filed on Jul. 29, 2019, and, Japanese Patent Application No. 2020-098542, filed on Jun. 5, 2020, which are hereby incorporated by reference herein in their entirety.

The invention claimed is:

1. An image forming apparatus comprising:

a body including a first pressing member, a second pressing member, a first body terminal, a second body terminal, a first supplying terminal, and a second supplying terminal;

a tray which is movable between a housed position at which the tray is housed in a housing portion of the body and a drawn-out position at which the tray is drawn out from the body, the tray including (i) a frame, (ii) a first photosensitive drum rotatably supported by the frame, (iii) a second photosensitive drum rotatably supported by the frame, (iv) a first tray terminal, (v) a second tray terminal, (vi) a first receiving terminal, (vii) a second receiving terminal, (viii) a first force receiving member being movable relative to the frame, and (ix) a second force receiving member being movable relative to the frame, wherein, in a state where the tray is in the housed position, the first tray terminal is electrically connected to the first body terminal, the first receiving terminal is electrically connected to the first supplying terminal, the second tray terminal is electrically connected to the second body terminal, the second receiving terminal is electrically connected to the second supplying terminal, a first cartridge configured to be detachably attached to the tray, the first cartridge including a first developing roller and a first memory configured to store information, wherein, in a state where the first cartridge is attached to the tray, the first developing roller contacts the first photosensitive drum and is electrically connected to the first receiving terminal, and the first memory is electrically connected to the first tray terminal; and a second cartridge configured to be detachably attached to the tray, the second cartridge including a second developing roller and a second memory configured to store information, wherein, in a state where the second cartridge is attached to the tray, the second developing roller contacts the second photosensitive drum and is electrically connected to the second receiving terminal, and the second memory is electrically connected to the second tray terminal, wherein, in a state where the first cartridge and the second cartridge are attached to the tray and the tray is in the housed position, the first pressing member is capable of pressing the first force receiving member such that the first developing roller separates from the first photosensitive drum, and the second pressing member is capable of pressing the second force receiving member such that the second developing roller separates from the second photosensitive drum, wherein, in the state where the first cartridge and the second cartridge are attached to the tray and the tray is in the housed position, the first tray terminal contacts the first body terminal at a first position, the second tray terminal contacts the second body terminal at a second position, the first receiving terminal contacts the first supplying terminal at a third position, and the second receiving terminal contacts the second supplying terminal at a fourth position, and wherein the first position is located below a position of a top surface of the first force receiving member and above the third position with respect to a vertical direction, and the second position is located below a position of a top surface of the second force receiving member and above the fourth position with respect to a vertical direction.

2. The image forming apparatus according to claim 1, wherein the first cartridge includes a first holding member to which the first memory is fixed and a first casing configured to store developer, the first holding member is movably supported by the first casing, wherein the second cartridge includes a second holding member to which the second memory is fixed and a second casing configured to store developer, the second holding member is movably supported by the second casing.

3. The image forming apparatus according to claim 1, the frame includes a first side wall located at a first end portion of the frame with respect to a rotational axis direction of the first photosensitive drum, and a second side wall located at a second end portion of the frame opposite to the first end portion with respect to the rotational axis direction, wherein the first side wall and the second side wall support the first photosensitive drum and the second photosensitive drum.

4. The image forming apparatus according to claim 3, wherein the tray is configured to move from the housed position to the drawn-out position along a direction crossing to the rotational axis direction.

5. The image forming apparatus according to claim 4, wherein the tray is configured to move from the housed position to the drawn-out position along a direction in which the first photosensitive drum and the second photosensitive drum are arranged.

6. The image forming apparatus according to claim 5, wherein the first memory includes a first memory terminal, the tray includes a first contacting terminal configured to contact the first memory terminal and electrically connected to the first tray terminal, the first contacting terminal and the first receiving terminal are closer to the first end portion than the second end portion with respect to the rotational axis direction, wherein the second memory includes a second memory terminal, the tray includes a second contacting terminal configured to contact the second memory terminal and electrically connected to the second tray terminal, the second contacting terminal and the second receiving terminal are closer to the first end portion than the second end portion with respect to the rotational axis direction.

7. The image forming apparatus according to claim 5, wherein the first memory includes a first memory terminal, the tray includes a first contacting terminal configured to contact the first memory terminal and electrically connected to the first tray terminal, the first contacting terminal is closer to the first end portion than the second end portion with respect to the rotational axis direction, and the first receiving terminal is closer to the second end portion than the first end portion with respect to the rotational axis direction, wherein the second memory includes a second memory terminal, the tray includes a second contacting terminal configured to contact the second memory terminal and electrically connected to the second tray terminal, the second contacting terminal is closer to the first end portion than the second end portion with respect to the rotational axis direction, and the second receiving terminal is closer to the second end portion than the first end portion with respect to the rotational axis direction.

8. The image forming apparatus according to claim 3, wherein the first memory includes a first memory terminal, the tray includes a first contacting terminal configured to contact the first memory terminal and electrically connected to the first tray terminal, the first contacting terminal and the first receiving terminal are closer to the first end portion than the second end portion with respect to the rotational axis direction, wherein the second memory includes a second memory terminal, the tray includes a second contacting terminal configured to contact the second memory terminal and electrically connected to the second tray terminal, the second contacting terminal and the second receiving terminal are closer to the first end portion than the second end portion with respect to the rotational axis direction.

9. The image forming apparatus according to claim 3, wherein the first memory includes a first memory terminal, the tray includes a first contacting terminal configured to contact the first memory terminal and electrically connected to the first tray terminal, the first contacting terminal is closer to the first end portion than the second end portion with respect to the rotational axis direction, and the first receiving terminal is closer to the second end portion than the first end portion with respect to the rotational axis direction, wherein the second memory includes a second memory terminal, the tray includes a second contacting terminal configured to contact the second memory terminal and electrically connected to the second tray terminal, the second contacting terminal is closer to the first end portion than the second end portion with respect to the rotational axis direction, and the second receiving terminal is closer to the second end portion than the first end portion with respect to the rotational axis direction.

10. The image forming apparatus according to claim 1, wherein the tray includes a first charger configured to charge a surface of the first photosensitive drum, and a second charger configured to charge a surface of the second photosensitive drum.

11. The image forming apparatus according to claim 1, wherein the frame provided with a recessed portion into which the first body terminal and the second body terminal are inserted.

* * * * *